US010660407B2

(12) United States Patent
Kawano

(10) Patent No.: US 10,660,407 B2
(45) Date of Patent: May 26, 2020

(54) WINDING DEVICE

(71) Applicant: JAPANA CO., LTD., Nagoya, Aichi (JP)

(72) Inventor: Fumiyoshi Kawano, Nagoya (JP)

(73) Assignee: JAPANA CO., LTD., Nagoya (JP)

( * ) Notice: Subject to any disclaimer, the term of this patent is extended or adjusted under 35 U.S.C. 154(b) by 0 days.

(21) Appl. No.: 16/323,456

(22) PCT Filed: Jul. 20, 2017

(86) PCT No.: PCT/JP2017/026317
§ 371 (c)(1),
(2) Date: Feb. 5, 2019

(87) PCT Pub. No.: WO2018/030108
PCT Pub. Date: Feb. 15, 2018

(65) Prior Publication Data

US 2019/0174872 A1 Jun. 13, 2019

(30) Foreign Application Priority Data

Aug. 10, 2016 (JP) ..... 2016-157594

(51) Int. Cl.
*A43C 11/16* (2006.01)
*A43C 11/20* (2006.01)
(Continued)

(52) U.S. Cl.
CPC ..... *A43C 11/165* (2013.01); *A43B 5/04* (2013.01); *A43C 11/00* (2013.01); *A43C 11/20* (2013.01); *A44B 11/12* (2013.01); *B65H 75/38* (2013.01)

(58) Field of Classification Search
CPC ..... A43C 11/165; A43C 11/20; A43C 11/00; A44B 11/12; A43B 5/04; B65H 75/38
See application file for complete search history.

(56) References Cited

U.S. PATENT DOCUMENTS 10,368,613 B2 * 8/2019 Ha ..... A43C 11/165
2007/0084956 A1 * 4/2007 Chen ..... A43C 7/00 242/388.6

(Continued)

FOREIGN PATENT DOCUMENTS

JP 3159620 5/2010
JP 2010-148927 7/2010

(Continued)

OTHER PUBLICATIONS

PCT/JP2017/026317, Oct. 17, 2017, International Search Report.

*Primary Examiner* — Robert Sandy
*Assistant Examiner* — Rowland Do
(74) *Attorney, Agent, or Firm* — Workman Nydegger

(57) ABSTRACT

A winding device 1 including a base 3 including a drum accommodation portion 33 that accommodates a drum 4 including upward teeth 46, the accommodation portion 33 being cylindrical and having a closed end, and a dial 5 including downward teeth (53) to rotate the drum 4. The dial 5 is moved to a locked state in which the downward teeth are engaged with the upward teeth 46 to transmit rotation of the dial 5 to the drum 4 and an unlocked state in which the downward teeth are disengaged from the upward teeth 46. The winding device 1 includes an annular gear (51) including projections and roots extending in the rotation axis direction of the dial 5 and a pawl 36 protruding from the drum accommodation portion 33. The pawl 36 is designed to engage with the annular gear. The annular gear and the pawl 36 control rotation of the dial.

3 Claims, 27 Drawing Sheets

(51) Int. Cl.

| | |
|---|---|
| ***A44B 11/12*** | (2006.01) |
| ***B65H 75/38*** | (2006.01) |
| ***A43B 5/04*** | (2006.01) |
| ***A43C 11/00*** | (2006.01) |

(56) References Cited

U.S. PATENT DOCUMENTS

| | | | | |
|---|---|---|---|---|
| 2010/0251524 | A1* | 10/2010 | Chen | A43C 7/00<br>24/713.2 |
| 2011/0266384 | A1 | 11/2011 | Goodman et al. | |
| 2012/0287004 | A1 | 11/2012 | Joshi et al. | |
| 2014/0097283 | A1* | 4/2014 | So | A44B 99/00<br>242/404 |
| 2014/0117140 | A1 | 5/2014 | Goodman et al. | |
| 2014/0359981 | A1 | 12/2014 | Cotterman et al. | |
| 2016/0120267 | A1 | 5/2016 | Burns et al. | |
| 2016/0213099 | A1* | 7/2016 | Ha | A43C 11/20 |
| 2017/0027287 | A1 | 2/2017 | Burns et al. | |

FOREIGN PATENT DOCUMENTS

| | | |
|---|---|---|
| JP | 2013-525007 | 6/2013 |
| JP | 2015-293 | 1/2015 |
| JP | 2015-297 | 1/2015 |
| JP | 2015-150426 | 8/2015 |
| JP | 2016-36679 | 3/2016 |
| JP | 5925765 | 4/2016 |
| JP | 2016-520401 | 7/2016 |
| WO | 2011/137405 | 11/2011 |

* cited by examiner (A)

Cross-sectional view taken along line X-X (B)

Dial: Locked state (C)

(A)

Cross-sectional view taken along line X-X (B)

Dial: Unlocked state

Second embodiment (A)

(B)

(A)

Cross-sectional view taken along line Y-Y (B)

Dial: Locked state (A)

Cross-sectional view taken along line Y-Y (B)

Dial: Unlocked state

Third embodiment: pawls protrude outward, spring portions are not included

Fourth embodiment: pawls protrude inward, spring portions are not included

Fourth embodiment: cylindrical annular gear, outward

Fifth embodiment: pawls protrude inward, spring portions are included

Sixth embodiment: pawls are formed in the lower part of the annular wall

Seventh embodiment: pawls protrudes from the base on the outside of the annular wall of the drum accommodation portion

Eighth embodiment: pawls are separate members and located on the same center circle as the annular wall

(A)

(B)

(C)

Ninth embodiment: pawls are separate members

Tenth embodiment: pawls are separate members, are located on the same center circle as the annular wall and protrude outward

Eleventh embodiment: pawls are separate members, are located on the same center circle as the annular wall and protrude inward

WINDING DEVICE

TECHNICAL FIELD

The present invention relates to a winding device; more specifically, to a winding device suitable for tightening the laces of various types of shoes. In addition to tightening laces of sport shoes used for jogging, golf, and the like, the winding device can be used to tighten laces used to fasten other types of shoes, or other products such as hat laces.

BACKGROUND ART

Conventionally, as shoelace winding devices suitable for tightening shoelaces, shoelace winding devices that wind shoelaces around a drum by rotating a dial (disk-shaped knob) and cancel the engaged state of the dial and the drum to cancel tightening of shoelaces with a single touch of a button by pulling the dial have been proposed (refer to Patent Documents 1 to 8 described below).

These conventional winding devices have problems such as (1) the structure of the dial that rotates the drum and changes the engaged state of the dial and the drum is complicated, (2) multiple components need to be assembled in order to configure the structure of the dial that rotates the drum and changes the engaged state of the dial and the drum, (3) the structure of a pawl configuring a ratchet mechanism that controls rotation of the dial and the structure of a spring that moves the position of the pawl are complicated, (4) multiple components need to be assembled in order to configure the structure of a pawl configuring a ratchet mechanism that controls rotation of the dial and the structure of a spring that moves the position of the pawl, and (5) a handle increases in size when forming a gear that includes projections and troughs extending radially on the inner surface of the dial.

The above-described winding devices have problems such as difficulty in reducing the size of the devices, high manufacturing costs, limits in the reliability and usage of the product if components have a decreased strength, and lengthy and intensive assembly and maintenance processes.

PRIOR ART DOCUMENT

Patent Documents

Patent Document 1: Japanese Laid-Open Patent Publication No. 2015-293

Patent Document 2: Japanese Laid-Open Patent Publication No. 2015-297

Patent Document 3: Japanese Laid-Open Patent Publication No. 2010-148927

Patent Document 4: Japanese Laid-Open Patent Publication No. 2016-36679

Patent Document 5: Japanese National Phase Laid-Open Patent Publication No. 2013-525007

Patent Document 6: International Publication No. WO2011/137405

Patent Document 7: Japanese Patent No. 5925765

Patent Document 8: Japanese Laid-Open Utility Model Publication No. 3159620

SUMMARY OF THE INVENTION

Problems that are to be Solved by the Invention

The problems that are to be solved by the invention is to solve the above-described problems, namely, (1) the structure of the dial that rotates the drum and changes the engaged state of the dial and the drum is complicated, (2) multiple components need to be coupled in order to configure the structure of the dial that rotates the drum and changes the engaged state of the dial and the drum, (3) the structure of a pawl configuring a ratchet mechanism that controls rotation of the dial and the structure of a spring that moves the position of the pawl are complicated, (4) multiple components need to be coupled in order to configure the structure of a pawl configuring a ratchet mechanism that controls rotation of the dial and the structure of a spring that moves the position of the pawl, and (5) a handle increases in size when forming a gear that includes projections and troughs extending radially on the inner surface of the dial.

It is an object of the present invention to solve the above-described problems and provide a winding device that simplifies the structure by reducing the number of components of the winding device, decreases the manufacturing cost, reduces the product in size and weight, increases the strength, durability, and reliability, and decreases the amount of time and effort needed for assembly and maintenance.

Means for Solving the Problem (1) The main feature of the present invention is a winding device includes a drum that includes upward teeth located on an upper side of the drum and is configured to wind a lace, a base including a drum accommodation portion that accommodates the drum, the accommodation portion being cylindrical and having a closed end, a dial including downward teeth located on a lower side of the dial and designed to engage with the upward teeth of the drum to rotate the drum, the dial being moved along a rotation axis direction of the dial to a locked state in which the downward teeth of the dial are engaged with the upward teeth of the drum to transmit rotation of the dial to the drum and a unlocked state in which the downward teeth are disengaged from the upward teeth of the drum to freely rotate the drum, an annular gear that is formed on a circumferential portion of the dial and includes projections and troughs extending in the rotation axis direction of the dial, and a pawl that protrudes from the drum accommodation portion and is designed to engage with the annular gear, thus the annular gear and the pawl controlling rotation of the dial.

(2) In the winding device of the present invention, the pawl may protrude outward or inward from a spring portion arranged concyclically with a cylindrical annular wall that configures the drum accommodation portion.

(3) In the winding device of the present invention, the pawl may protrude outward from a spring portion located in a lower part of a cylindrical annular wall that configures the drum accommodation portion.

(4) In the winding device of the present invention, the pawl may be integrated with a cylindrical annular wall that configures the drum accommodation portion.

(5) In the winding device of the present invention, the pawl may protrude outward from a spring portion formed by cutting out a cylindrical annular wall that configures the drum accommodation portion, and elastic deformation of the spring portion toward an inside of the drum accommodation portion may cause the pawl to slide up and over the projection of the annular gear, which is formed to be cylindrical on the circumferential portion of the dial, allowing the dial to rotate.

(6) In the winding device of the present invention, the pawl may protrude inward from a spring portion formed by cutting out a cylindrical annular wall that configures the drum accommodation portion, and elastic deformation of the spring portion toward an outside of the drum accommodation portion may cause the pawl to slide up and over the projection of the annular gear, which is formed to be columnar on the circumferential portion of the dial, allowing the dial to rotate.

(7) In the winding device of the present invention, a cutout formed on the annular wall, which is cylindrical, may spread outward, and a gap between an inside of the cutout and the spring portion may be extremely small.

(8) Additionally, the present invention is a winding device including a drum that includes upward teeth located on an upper side of the drum and is configured to wind a lace, a base including a drum accommodation portion that accommodates the drum, the accommodation portion being cylindrical and having a closed end, a dial including downward teeth located on a lower side of the dial and designed to engage with the upward teeth of the drum to rotate the drum, the dial being moved along a rotation axis direction of the dial to a locked state in which the downward teeth of the dial are engaged with the upward teeth of the drum to transmit rotation of the dial to the drum and a unlocked state in which the downward teeth are disengaged from the upward teeth of the drum to freely rotate the drum, an annular gear that is formed on a circumferential portion of the dial and includes projections and troughs extending in the rotation axis direction of the dial, and a pawl that protrude from a base located outside the drum accommodation portion and is designed to engage with the annular gear, thus the annular gear and the pawl controlling rotation of the dial.

(9) In the winding device of the present invention, the dial may integrally include the downward teeth and the annular gear, and the dial may accommodate a spring that switches the dial between a locked position at which rotation of the dial is transmitted to the drum and a cancelled position at which the drum freely rotates and may accommodate a shaft member that holds the spring.

(10) In addition, the present invention is a winding device including a drum that includes upward teeth located on an upper side of the drum and is configured to wind a lace, a base including a drum accommodation portion that accommodates the drum, the accommodation portion being cylindrical and having a closed end, a dial including downward teeth located on a lower side of the dial and designed to engage with the upward teeth of the drum to rotate the drum, the dial being moved along a rotation axis direction of the dial to a locked state in which the downward teeth of the dial are engaged with the upward teeth of the drum to transmit rotation of the dial to the drum and a unlocked state in which the downward teeth are disengaged from the upward teeth of the drum to freely rotate the drum, an annular gear that is formed on a circumferential portion of the dial and includes projections and troughs extending in the rotation axis direction of the dial, and a pawl that is located on the same center circle as an annular wall that configures the drum accommodation portion and designed to engage with the annular gear, thus the annular gear and the pawl controlling rotation of the dial.

(11) In the winding device of the present invention, the pawl may be provided on an annular portion located on the same center circle as the annular wall, which configures the drum accommodation portion.

(12) Further, in the winding device of the present invention, the pawl may protrude outward or inward from a spring portion located on the annular portion.

Effects of the Invention (1) In the above-described winding device of the present invention, rotation of the dial can be controlled by the dial including the annular gear with a simple structure and by the drum accommodation portion including the pawl.

This reduces the number of components of the winding device, simplifies the structure, reduces the size and weight of the winding device, increases the strength, durability, and reliability, and decreases the amount of time and effort needed for assembly and maintenance.

(2) In the winding device of the present invention, the pawl protrudes outward or inward from a spring portion arranged concyclically with a cylindrical annular wall that configures the drum accommodation portion. This simplifies the structure and reduces the device in size.

(3) In the winding device of the present invention, the pawl protrudes outward from a spring portion located in a lower part of a cylindrical annular wall that configures the drum accommodation portion. This reduces the thickness of the winding device to reduce the size of the winding device and protects the spring portion.

(4) In the winding device of the present invention, the pawl is integrated with a cylindrical annular wall that configures the accommodation portion. This increases the strength of the device and simplifies the structure of the device, thereby significantly reducing the amount of time and effort needed for assembly and maintenance.

(5) In the winding device of the present invention, the pawl protrudes outward from a spring portion formed by cutting out a cylindrical annular wall that configures the drum accommodation portion, and elastic deformation of the spring portion toward an inside of the drum accommodation portion causes the pawl to slide up and over the projection of the annular gear, which is formed to be cylindrical on the circumferential portion of the dial, allowing the dial to rotate. This simplifies the structures of the pawl that controls rotation of the dial and the spring that moves the position of the pawl. This also increases the strength of the pawl and the spring.

(6) In the winding device of the present invention, the pawl protrudes inward from a spring portion formed by cutting out a cylindrical annular wall that configures the drum accommodation portion, and elastic deformation of the spring portion toward an outside of the drum accommodation portion causes the pawl to slide up and over the projection of the annular gear, which is formed to be columnar on the circumferential portion of the dial, allowing the dial to rotate. This simplifies the structures of the pawl that controls rotation of the dial and the spring that moves the position of the pawl. This also increases the strength of the pawl and the spring.

(7) In the winding device of the present invention, a cutout formed on the annular wall, which is cylindrical, spreads outward, and a gap between an inside of the cutout and the spring portion is extremely small. This facilitates removal from a mold and prevents foreign matter into entering the device, thereby increasing the reliability of the device.

In addition, the die that forms the annular wall including the cutout, which spreads outward, is thick at the spreading cutout parts. This increases the strength of the die and prevents the die from being damaged during removal from a mold and manipulation.

(8) The winding device of the present invention includes the pawl that protrudes from the base located outside the drum accommodation portion and engages with the annular gear. This simplifies the structure of the drum accommodation portion and increases its strength. This also prevents foreign matter from entering into the drum accommodation portion, thereby increasing the reliability of the device.

(9) In the winding device of the present invention, the dial integrally includes the downward teeth and the annular gear, and the dial accommodates a spring that switches the dial between a locked position at which rotation of the dial is transmitted to the drum and a cancelled position at which the drum freely rotates and accommodates a shaft member that holds the spring. Thus, the winding device is excellent in durability and operability.

(10) The winding device of the present invention includes a pawl located on the same center circle as an annular wall that configures the drum accommodation portion and designed to engage with the annular gear. This simplifies the structure of the winding device and increases the strength, durability, and reliability of the winding device.

(11) In the winding device of the present invention, the pawl is provided on an annular portion located on the same center circle as the annular wall, which configures the drum accommodation portion. This increases the strength, durability, and reliability of the winding device.

(12) In the winding device of the present invention, the pawl protrudes outward or inward from a spring portion located on the annular wall. This decreases the amount of time and effort necessary for maintenance.

MODES FOR CARRYING OUT THE INVENTION

The present invention is a winding device including a drum that includes upward teeth located on an upper side of the drum and is configured to wind a lace, a base including a drum accommodation portion that accommodates the drum, the accommodation portion being cylindrical and having a closed end, a dial including downward teeth located on a lower side of the dial and designed to engage with the upward teeth of the drum to rotate the drum, the dial being moved along a rotation axis direction of the dial to a locked state in which the downward teeth of the dial are engaged with the upward teeth of the drum to transmit rotation of the dial to the drum and a unlocked state in which the downward teeth are disengaged from the upward teeth of the drum to freely rotate the drum, an annular gear that is formed on a circumferential portion of the dial and includes projections and troughs extending in the rotation axis direction of the dial, and a pawl that protrudes from the drum accommodation portion and is designed to engage with the annular gear, thus the annular gear and the pawl controlling rotation of the dial. The present invention is applicable to the embodiments described below in a more preferred manner.

An embodiment (first embodiment: FIGS. 1 to 10) in which the winding device of the present invention is applied to a winding device that winds the shoelaces of sport shoes will now be described.

The internal structure and the advantages of the embodiments of the winding device of the present invention have already been partially disclosed by the applicants of the present application in Japanese Patent Application No. 2013-127574 (Japanese Laid-Open Patent Publication No. 2015-293), Japanese Patent Application No. 2013-127612 (Japanese Laid-Open Patent Publication No. 2015-297), and Japanese Patent Application No. 2014-163867 (Japanese Laid-Open Patent Publication No. 2016-36679).

Figure 1:
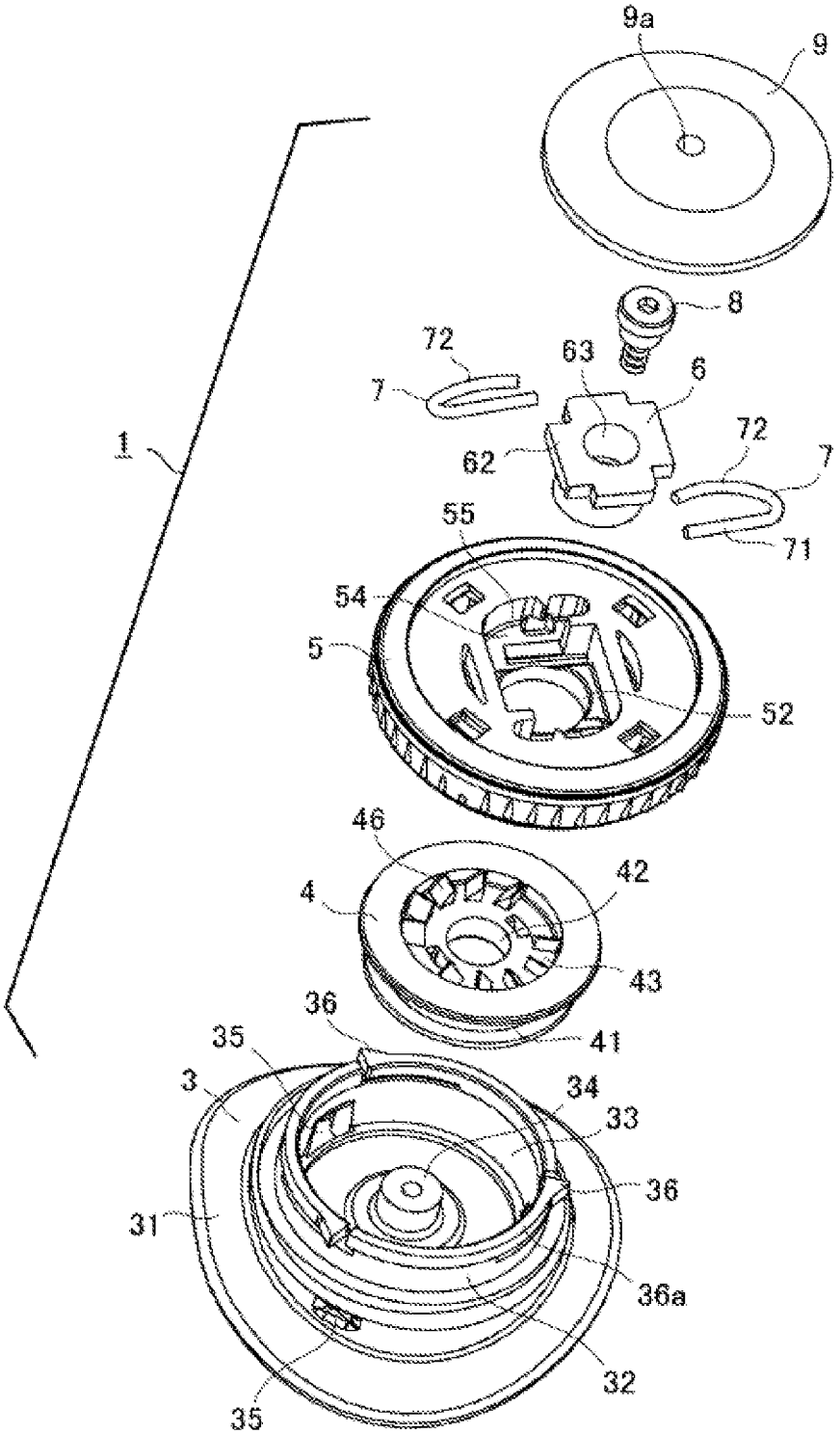
FIG. 1 is an exploded perspective view showing a shoelace winding device according to a first embodiment of the present invention.
Figure 2:
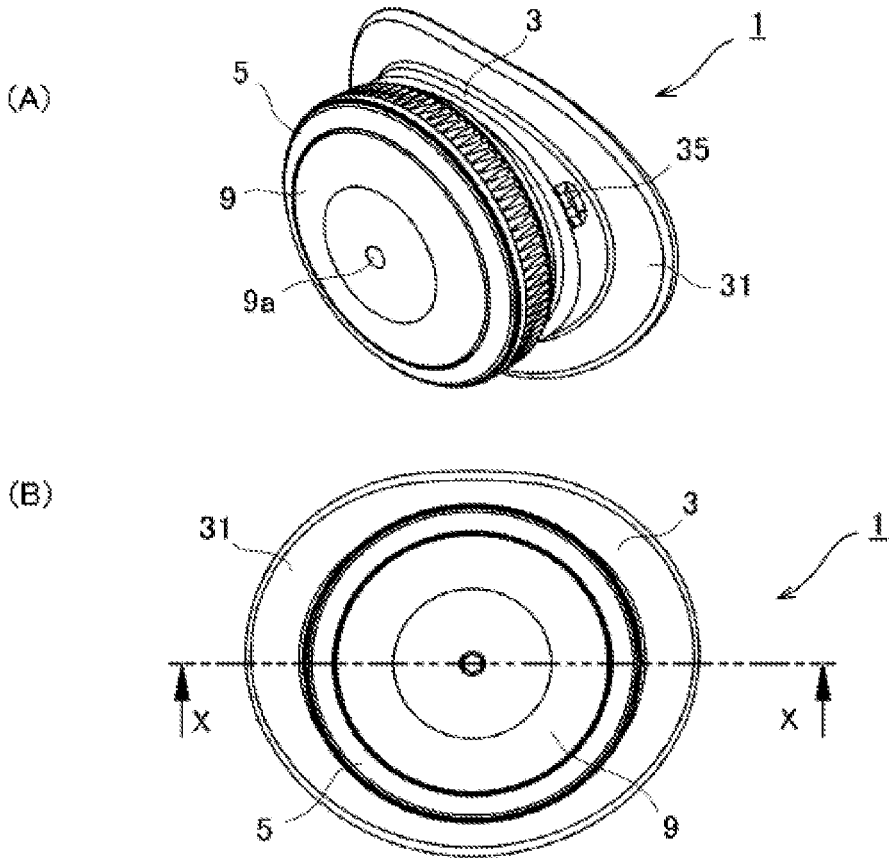
FIG. 2A is a perspective view of the shoelace winding device according to the first embodiment of the present invention.
FIG. 2B is a plan view of the shoelace winding device according to the first embodiment of the present invention.
Figure 3:
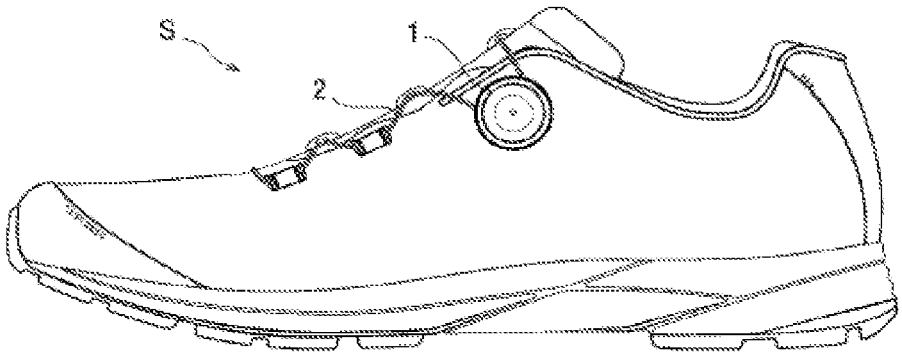
FIG. 3 is a side view showing a shoe to which the shoelace winding device according to the first embodiment of the present invention is attached.
Figure 4:
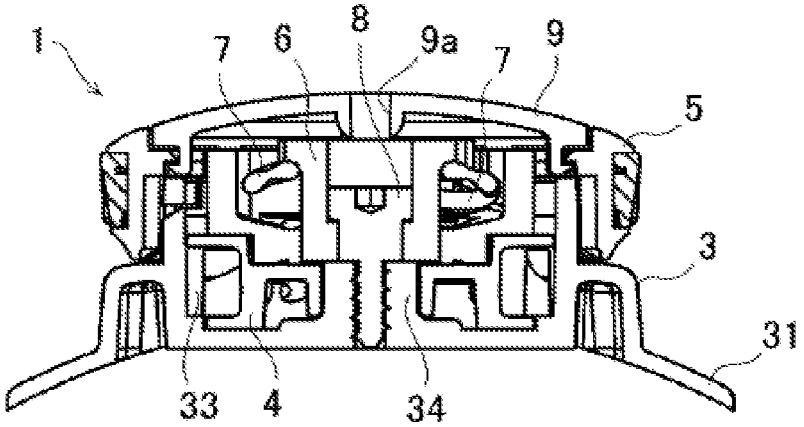
FIG. 4A is a cross-sectional view taken along line X-X in FIG. 2B, showing a locked state of the shoelace winding device according to the first embodiment of the present invention.
FIG. 4B is a front view of the shoelace winding device according to the first embodiment of the present invention, showing the locked state of the shoelace winding device according to the first embodiment of the present invention.
FIG. 4C is a partially enlarged cross-sectional view of the shoelace winding device according to the first embodiment of the present invention, showing an annular wall in the proximity of a pawl.
Figure 4:
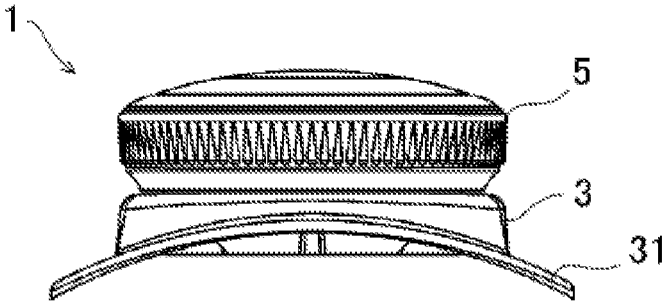
Figure 4:
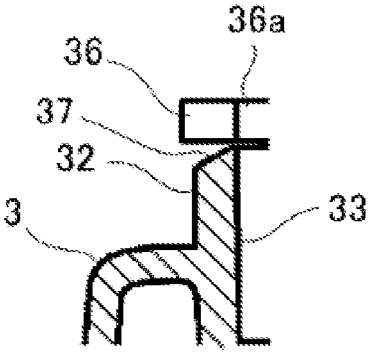
Figure 5:
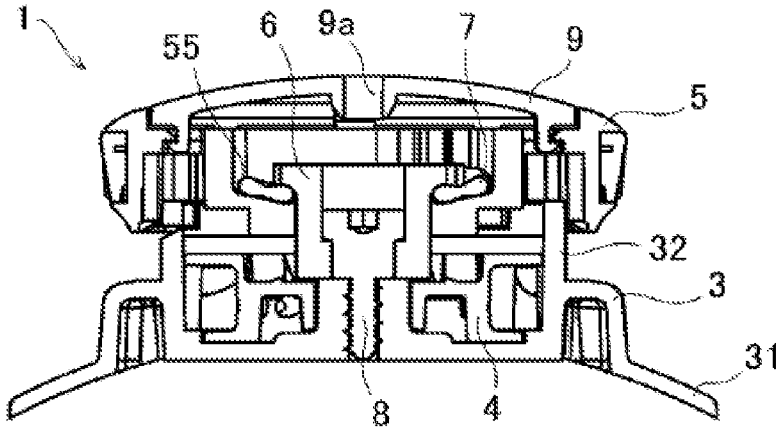
FIG. 5A is a cross-sectional view taken along line X-X in FIG. 2B, showing an unlocked state of the shoelace winding device according to the first embodiment of the present invention.
FIG. 5B is a front view of the shoelace winding device according to the first embodiment of the present invention, showing the unlocked state of the shoelace winding device according to the first embodiment of the present invention.
Figure 5:
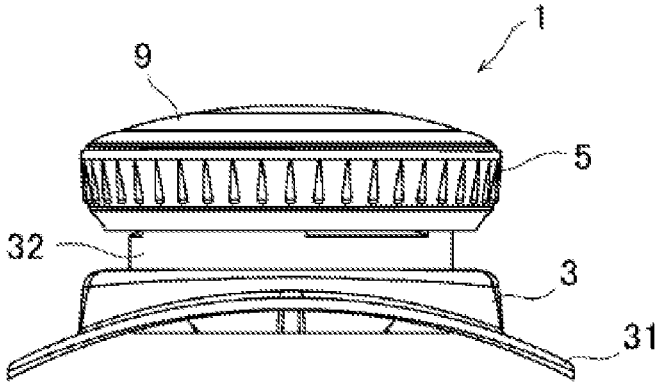
Figure 6:
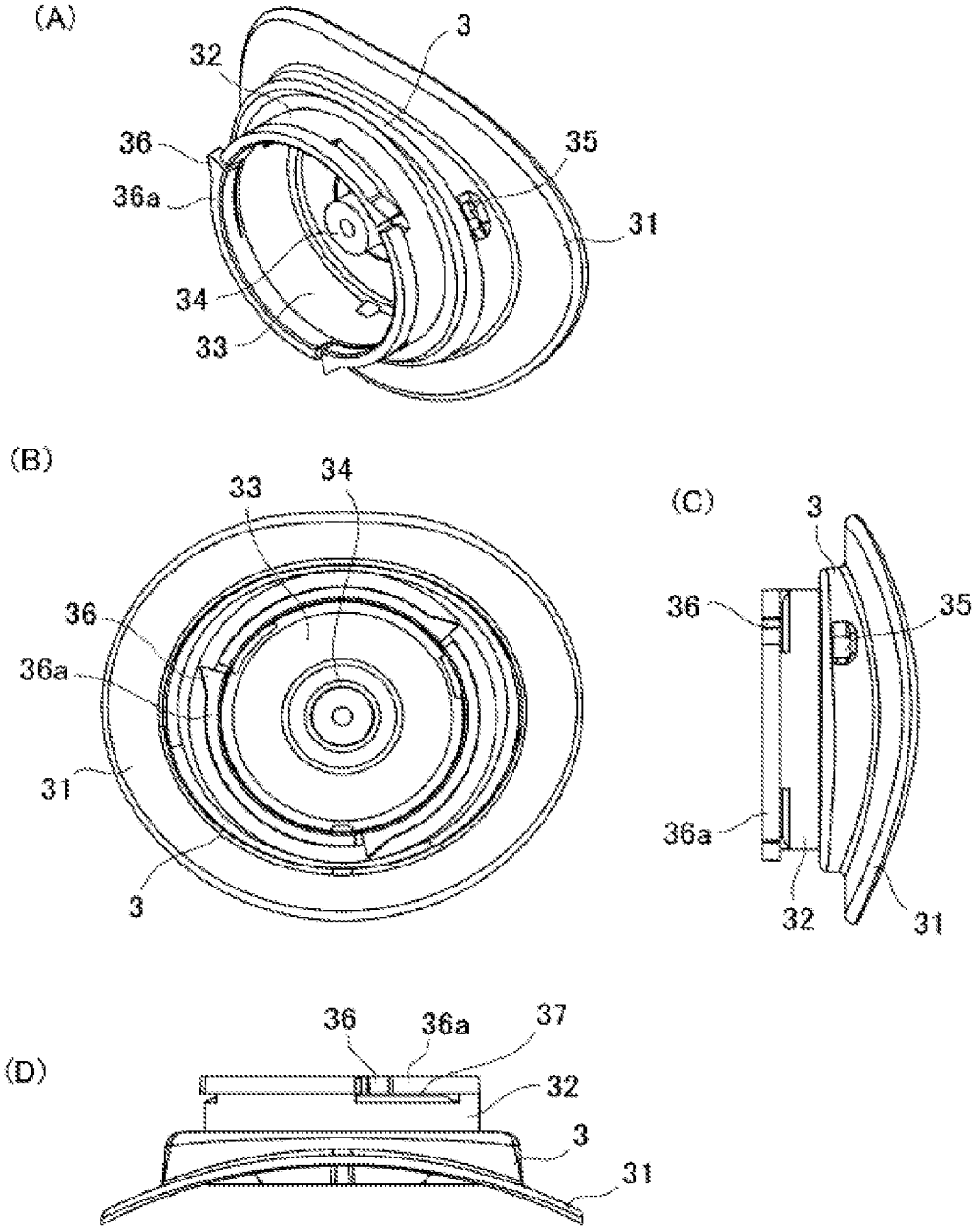
FIG. 6A is a perspective view showing a base of the shoelace winding device according to the first embodiment of the present invention.
FIG. 6B is a plan view showing the base of the shoelace winding device according to the first embodiment of the present invention.
FIG. 6C is a side view showing the base of the shoelace winding device according to the first embodiment of the present invention.
FIG. 6D is a front view showing the base of the shoelace winding device according to the first embodiment of the present invention.
Figure 7:
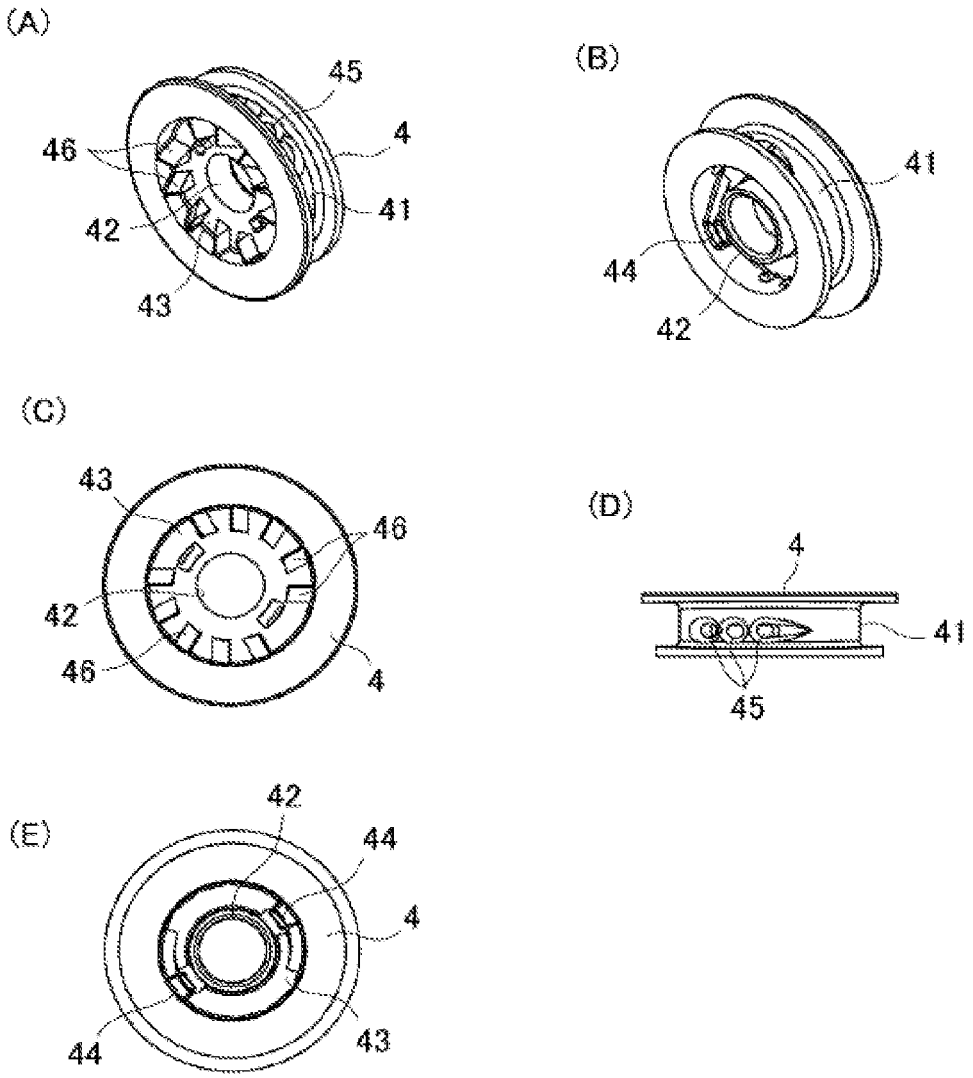
FIG. 7A is a perspective view of a drum that can be used for the shoelace winding device according to the first embodiment of the present invention, showing upward teeth.
FIG. 7B is a perspective view of the drum that can be used for the shoelace winding device according to the first embodiment of the present invention, showing locking protuberances.
FIG. 7C is a plan view of the drum that can be used for the shoelace winding device according to the first embodiment of the present invention.
FIG. 7D is a side view of the drum that can be used for the shoelace winding device according to the first embodiment of the present invention.
FIG. 7E is a bottom view of the drum that can be used for the shoelace winding device according to the first embodiment of the present invention.
Figure 8:
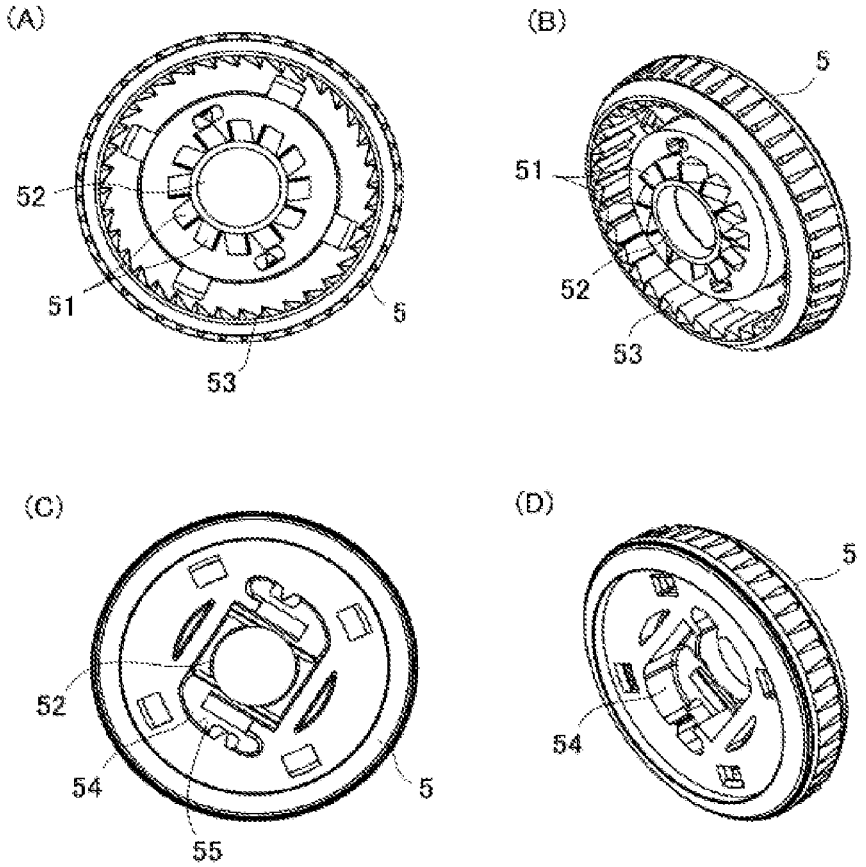
FIG. 8A is a bottom view showing a dial of the shoelace winding device according to the first embodiment of the present invention.
FIG. 8B is a perspective view of the dial of the shoelace winding device according to the first embodiment of the present invention, showing downward teeth.
FIG. 8C is a plan view showing the dial of the shoelace winding device according to the first embodiment of the present invention.
FIG. 8D is a perspective view of the dial of the shoelace winding device according to the first embodiment of the present invention, showing the flat side.
Figure 9:
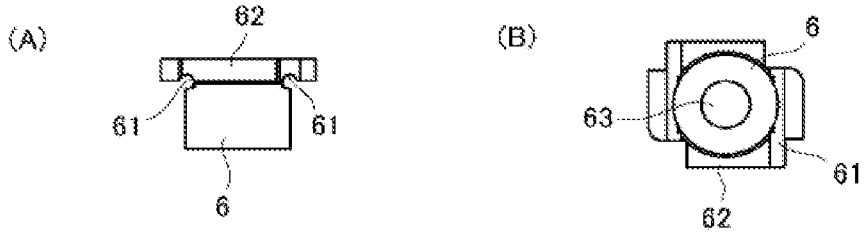
FIG. 9A is a side view showing a shaft member of the shoelace winding device according to the first embodiment of the present invention.
FIG. 9B is a bottom view showing the shaft member of the shoelace winding device according to the first embodiment of the present invention.
Figure 10:
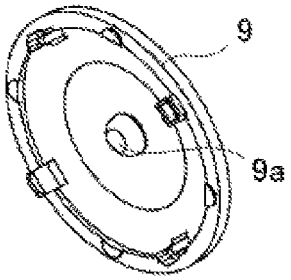
FIG. 10 is a perspective view showing the bottom surface of a cover of the shoelace winding device according to the first embodiment of the present invention.
Figure 11:
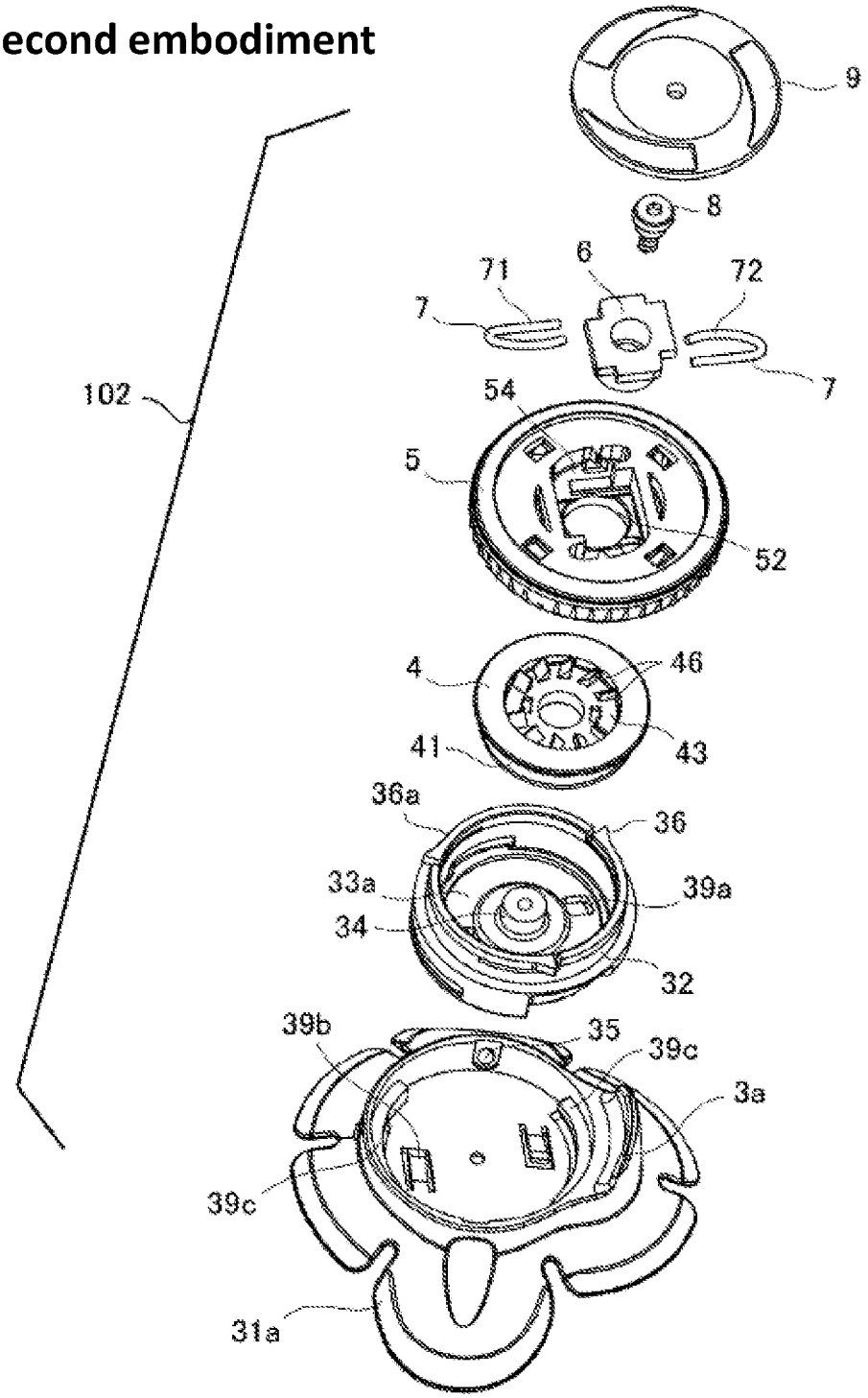
FIG. 11 is an exploded perspective view showing a shoelace winding device according to a second embodiment of the present invention.
Figure 12:
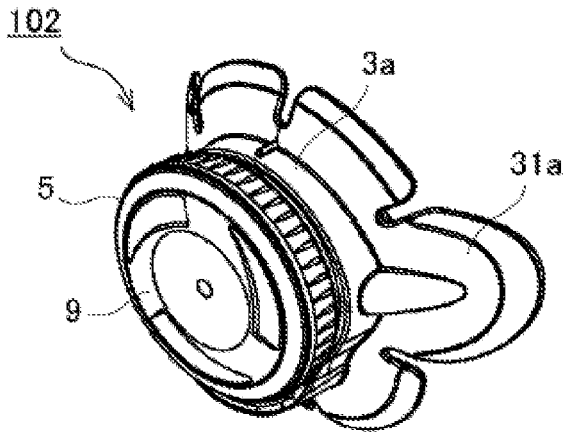
FIG. 12A is a perspective view of the shoelace winding device according to the second embodiment of the present invention.
FIG. 12B is a plan view of the shoelace winding device according to the second embodiment of the present invention.
Figure 12:
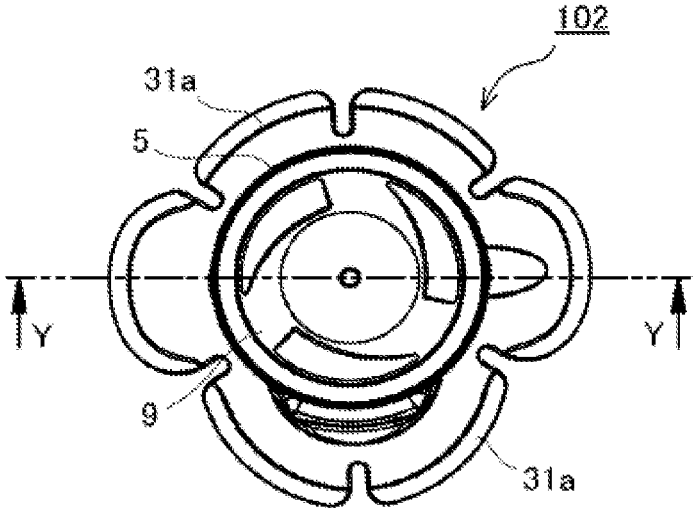

FIG. 3 shows a shoelace winding device 1 according to an embodiment of the present invention and a shoe S provided with the shoelace winding device 1 at a position corresponding to an ankle. In the shoe S, the instep part of the shoe S can be tightened with a shoelace 2 configured by, for example, a plastic-coated metal wire.

The shoelace winding device 1 includes, for example, a base 3, a drum 4 around which the shoelace 2 is wound, a dial 5 that rotates the drum 4 and is substantially disk-shaped, a shaft member 6 rotationally fixed to the base 3 to mount the dial 5 to the base 3, and spring members 7. A first end of each spring member 7 is supported by the shaft member 6.

The shoelace 2 may be a wire-like shoelace or a shoelace made of plastic in a preferred manner depending on the purpose of use. A wire-like shoelace is made by intertwining stainless steel strands having a diameter of 0.11 to 0.13 mm to form a cord, working the cord with a swaging machine, and then coating the cord with nylon plastic. A plastic shoelace is made of nylon plastic or the like.

The entire base 3 is integrated by forming a thin-plate flange 31 so as to protrude from the surroundings of a drum accommodation portion 33. The drum accommodation portion 33 includes a cylindrical annular wall 32 to rotationally accommodate the drum 4. The flange 31 is fixed to the shoe S using sewing threads to allow the shoelace winding device 1 to be fixed to the shoe S.

A rotation shaft 34 that supports the drum 4 protrudes from the bottom center of the drum accommodation portion 33.

Further, the bottom of the drum accommodation portion 33 is provided with two shoelace drawing ports 35.

The upper end of the annular wall 32 is provided with three pawls 36 protruding outward from the annular wall 32. The pawls 36 are formed at equal intervals and each located on the tip of an elongated, bar-shaped spring portion 36*a* that is curved in an arcuate manner by partially cutting out the annular wall 32.

More specifically, the spring portions 36*a* and the pawls 36 are integrated with the base 3 and the annular wall 32, and the spring portions 36*a* are located concyclically with the annular wall 32 compactly.

Elastic deformation of the spring portions 36*a* allows the pawls 36 to move toward the inside of the drum accommodation portion 33.

Further, a cutout 37 is formed on the annular wall 32 to provide each spring portion 36*a*. Each cutout 37 spreads outward, and the gap between the inside of the cutout 37 and the spring portion 36*a* is extremely small. This facilitates removal from a mold, prevents foreign matter from entering the device, and increases the reliability of the device (refer to FIG. 4C).

In addition, the die that forms the annular wall 32 including the cutouts 37, which spread outward, is thick at the spreading cutout portions. This increases the strength of the die and prevents the die from being damaged during removal from a mold and manipulation.

The spring portions 36*a* have an increased strength when formed to be short, and can avoid breakage and damage of the spring portions 36*a* under forcible manipulation of the dial 5.

The drum 4 includes a shoelace winding portion 41 around which the shoelace 2 is wound and a rotation shaft portion 42 located inside the shoelace winding portion 41. Further, recesses 43 are formed on the upper and lower surfaces of the drum 4 between the shoelace winding portion 41 and the rotation shaft portion 42.

The rotation shaft 34 of the base 3 is inserted into the rotation shaft portion 42, allowing the drum 4 to rotate in the drum accommodation portion 33.

The lower recess 43 of the drum 4 faces the inner bottom of the drum accommodation portion 33. The recess 43 accommodates two locking protuberances 44.

The shoelace winding portion 41 has wire insertion holes 45. The tips of the shoelace 2 drawn from the wire insertion holes 45 into the recesses 43 are held by the locking protuberances 44 in between. This allows the tips of the shoelace 2 to be kept in the recess 43.

The upper recess 43 of the drum 4 includes upward teeth 46 formed along the inner circumferential surface of the shoelace winding portion 41. When the upward teeth 46 mesh with downward teeth 51 on the lower surface of the dial 5, rotation of the dial 5 is transmitted to the drum 4.

The dial 5 has a shaft hole 52 located at the central portion of the dial 5. The downward teeth 51 are arranged around the shaft hole 52 in an annular manner.

The dial 5 further includes a cylindrical annular gear 53 located on the inner surface of the surrounding portion of the dial 5. The annular gear 53 includes projections and troughs extending in a rotation axis direction of the dial 5.

The troughs of the annular gear 53 and the pawls 36 are arranged so that they mesh with each other. When the dial 5 is rotated, the pawls 36 slide up and over the projections of the annular gear to control the dial 5 to rotate only in a single direction.

More specifically, the annular gear 53 and the pawls 36 configure a ratchet mechanism. The cross sections of the projections of the annular gear 53 have the shape of a saw blade so that the annular gear 53 (the dial 5) can rotate only in a direction in which the shoelace 2 is wound and tightened.

Additionally, the dial 5 is movable along its rotation axis direction to a locked state or an unlocked state. In the locked state, the upward teeth 46 and the downward teeth 51 mesh with each other to transmit rotation of the dial 5 to the drum 4. In the unlocked state, the drum 4 is located away from the dial 5 so that the upward teeth 46 and the downward teeth 51 are disengaged from each other to freely rotate the drum 4.

The shaft member 6 is fixed to the base 3 by a screw 8 so that the dial 5 is rotationally mounted on the base 3. The shaft member 6 can hold and guide the dial 5 in a movable state between a locked position at which the dial 5 is located close to the drum 4 and a cancelled position at which the dial 5 is located away from the drum 4.

The shaft member 6 is columnar. The straight first end (shaft part 71) formed on each spring member 7 is inserted into a bearing 61 formed by cutting out facing side parts of the shaft member 6 in the proximity of the upper end of the shaft member 6 in a direction orthogonal to the axial direction of the shaft member 6. This pivotally supports the spring members 7. That is, the spring members 7 are arranged one by one at positions spaced apart by approximately 180 degrees of the shaft member 6.

The spring members 7 are located in spring accommodation portions 54 formed adjacent to the shaft hole 52 of the dial 5. The entire spring members 7 are curved in a substantially U-shaped manner. The spring members 7 each include a curved second end 72 that constantly abuts a locking portion 55 on the spring accommodation portion 54.

Movement of the dial 5 from the locked position to the cancelled position allows the drum 4 to be switched from the locked state to the unlocked state.

Further, a reverse position is set between the locked position and the cancelled position. At the reverse position, the second ends 72 of the spring members 7 are compressed most strongly toward the shaft member 6.

A disk-shaped cover 9 is fitted to the upper side of the dial 5. This protects the inside of the shoelace winding device 1 and prevents foreign matter from entering the shoelace winding device 1.

The central part of the cover 9 has a through-hole 9*a*. The drum 4, the dial 5, and the shaft member 6 can be removed from the base 3 by operating the screw 8 located on the inner side (lower side) of the cover 9 through the through-hole 9*a*.

The manufacturing method for coupling the above-described components of the shoelace winding device 1 will now be described.

First, in order to mount the drum 4 to the base 3 of the shoelace winding device 1, the tips of the shoelace 2 are respectively inserted into the two shoelace drawing ports 35, and the two ends of the shoelace 2 are drawn from the drum accommodation portion 33.

Next, the tips of the shoelace 2 are sequentially inserted through six wire insertion holes 45 of the drum 4 in a zigzag manner to fix the two ends of the shoelace 2 to the drum 4. Then, the drum 4 is placed in the drum accommodation portion 33.

Subsequently, the shaft member 6 and the spring members 7 are coupled to the dial 5.

A flange 62 protruding from the upper end of the shaft member 6 abuts the surroundings of the shaft hole 52 of the dial 5. This prevents the removal of the dial 5 from the shaft member 6.

After the shaft member 6 and the spring members 7 are coupled to the dial 5 in the above-described procedure, the screw 8 is inserted through a screw insertion hole 63 extending through the shaft member 6 along the axis of the shaft member 6 to mount the shaft member 6 and the like on the base 3.

Lastly, the cover 9 is fitted to the dial 5 to couple the shoelace winding device 1.

To disassemble the shoelace winding device 1 for maintenance and repair, a screwdriver is inserted from the through-hole 9*a* of the cover 9 to remove the screw 8. In this manner, the dial 5, the shaft member 6, and the spring member 7 that are coupled together can be separated from the base 3.

For the materials that configure the components of the shoelace winding device 1 of the present embodiment, the following materials are used as an example taking into account, for example, strength, durability, and elasticity. However, these materials do not have to be used.

Base 3: nylon

Drum 4, Shaft member 6: polyacetal (POM)

Dial 5: nylon and thermoplastic elastomer (TPE) on the surroundings of the nylon Spring member 7: stainless steel Screw 8: carbon steel Cover 9: ABS plastic The method for using the shoelace winding device 1 will now be described.

In order to tighten the shoelace 2 after putting on the shoe S, the dial 5 of the shoelace winding device 1 is rotated at the locked position, where the dial 5 is located close to the base 3 shown in FIGS. 4A and 4B, to wind the shoelace 2 around the drum 4.

In this case, the projections of the annular gear 53 of the dial 5 abut the pawls 36 to prevent the drum 4 from rotating in a direction in which the shoelace 2 is loosened.

In addition, the reverse position, where the spring member 7 is compressed most strongly, is set between the locked position and the cancelled position. Thus, with the dial 5 located at the locked position, the dial 5 is biased downward by the spring member 7 to keep the dial 5 at the locked position.

Subsequently, to loosen the fastened shoelace 2, the dial 5 of the shoelace winding device 1 is pulled upward.

In this state, the spring member 7 is compressed. Pulling the dial 5 further upward against the repulsive force moves the dial 5 beyond the reverse position, where the spring member 7 is compressed most strongly, and switches the compressing direction of the spring member 7 between the locked position and the cancelled position. This moves the dial 5 to the cancelled position, where the dial 5 is located away from the base 3 (state shown in FIG. 5).

The second ends 72 of the spring members 7 constantly abut the locking portions 55 on the inner surface of the dial 5 (inner surfaces of the spring accommodation portions 54). This prevents wear of the components.

Further, since the spring member 7 is clearly switched between the locked position and the cancelled position, the operability is excellent. In addition, the state of the position of the dial 5 can be easily checked.

When the dial 5 moves from the locked position to the cancelled position as described above, meshing of the upward teeth 46 of the drum 4 with the downward teeth 51 of the dial 5 are cancelled smoothly. This allows the drum 4 to freely rotate, thereby loosening the shoelace 2.

When the dial 5 is forced downward to move from the cancelled position to the locked position, the dial 5 moves beyond the reverse position, where the spring member 7 is compressed most strongly, in the opposite direction. This causes the upward teeth 46 of the drum 4 to mesh again with the downward teeth 51 of the dial 5. Thus, the shoelace 2 can be wound around the drum 4, thereby tightening the shoelace 2.

In this specification, the word "dial" is not particularly limited in shape as long as the dial acts as an operation portion that drives the drum 4. The dial may be polygonal.

The rear surface of the dial needs to include the annular gear 53.

The winding device of the present invention may be embodied so that the spring member 7 does not move beyond the reverse position and the spring member 7 constantly biases the dial 5.

In this case, the unlocked state, in which the downward teeth 51 are disengaged from the upward teeth 46 of the drum 4 to allow the drum 4 to freely rotate, occurs only while the dial 5 is being lifted upward. Releasing the hand from the dial 5 immediately returns the unlocked state to the locked state.

The winding device of the present invention is not limited to the shoelace winding device 1, which is arranged on the instep part of the shoe S as shown in FIG. 3. Instead, the winding device of the present invention may be applied to a shoelace winding device for tightening the shoelace 2 that tightens a different part of the shoe S.

Figure 13:
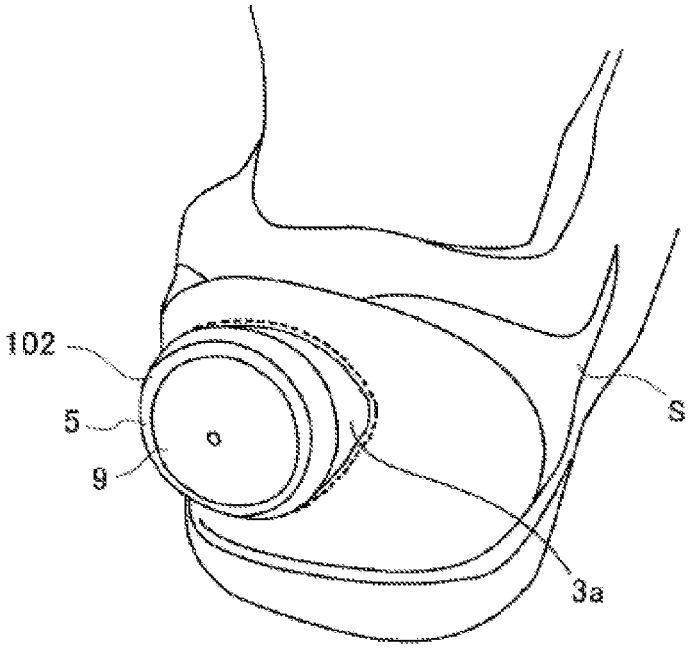
FIG. 13 is a perspective view showing the heel part of a shoe to which the shoelace winding device according to the second embodiment of the present invention is attached.
Figure 14:
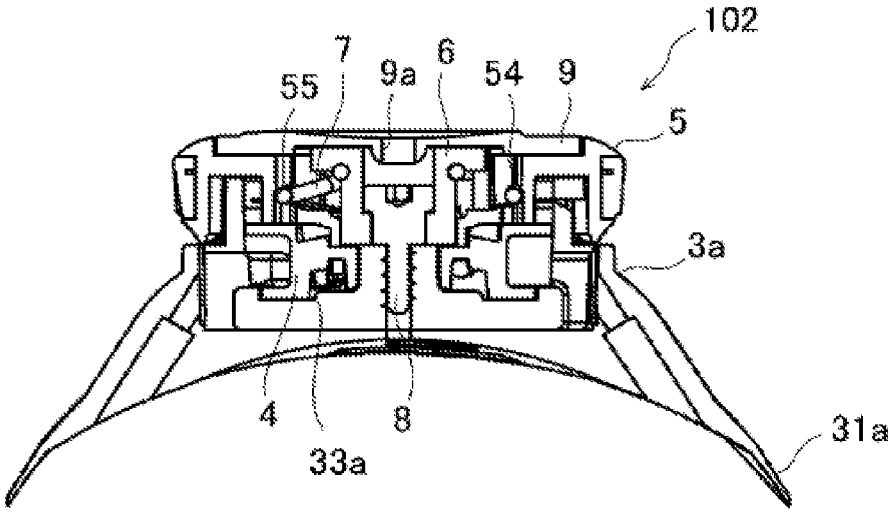
FIG. 14A is a cross-sectional view taken along line Y-Y in FIG. 12B, showing a locked state of the shoelace winding device according to the second embodiment of the present invention.
FIG. 14B is a front view of the shoelace winding device according to the second embodiment of the present invention, showing the locked state.
Figure 14:
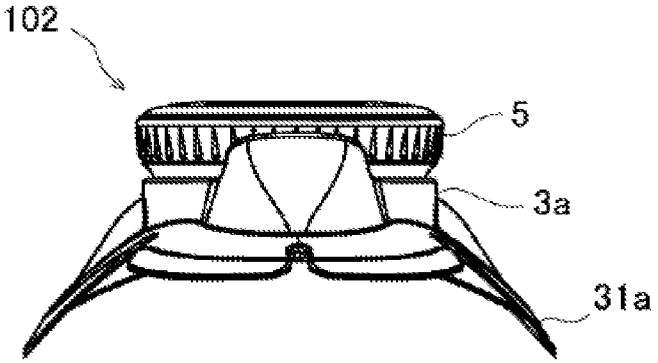
Figure 15:
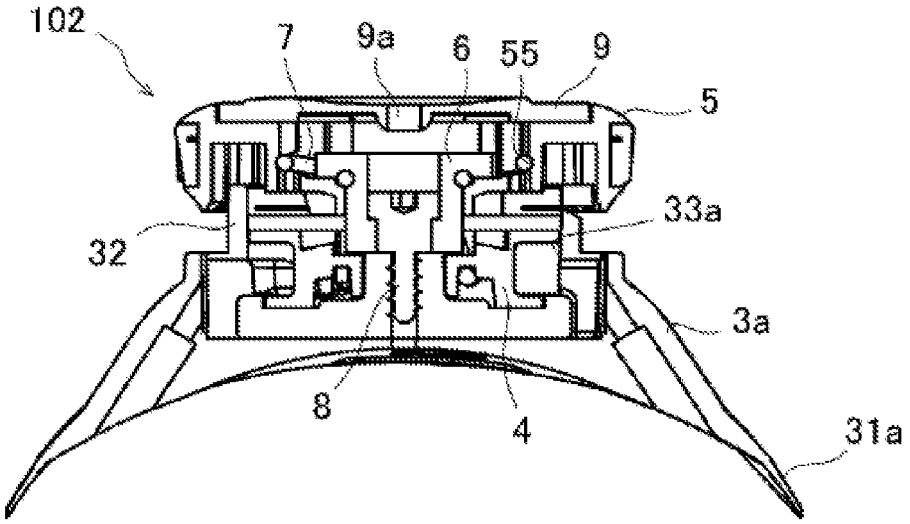
FIG. 15A is a cross-sectional view taken along line Y-Y in FIG. 12B, showing an unlocked state of the shoelace winding device according to the second embodiment of the present invention.
FIG. 15B is a front view of the shoelace winding device according to the second embodiment of the present invention, showing the unlocked state.
Figure 15:
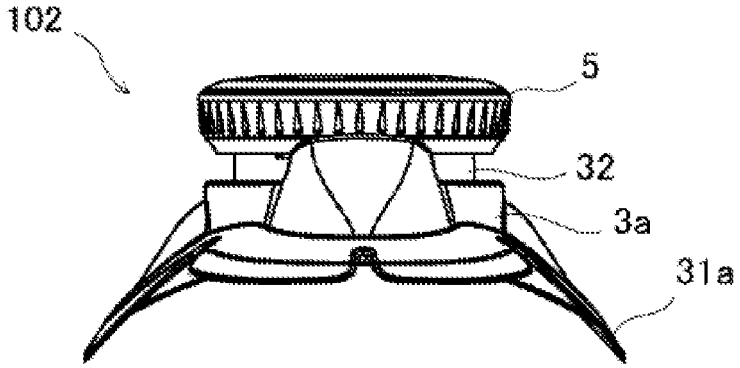
Figure 16:
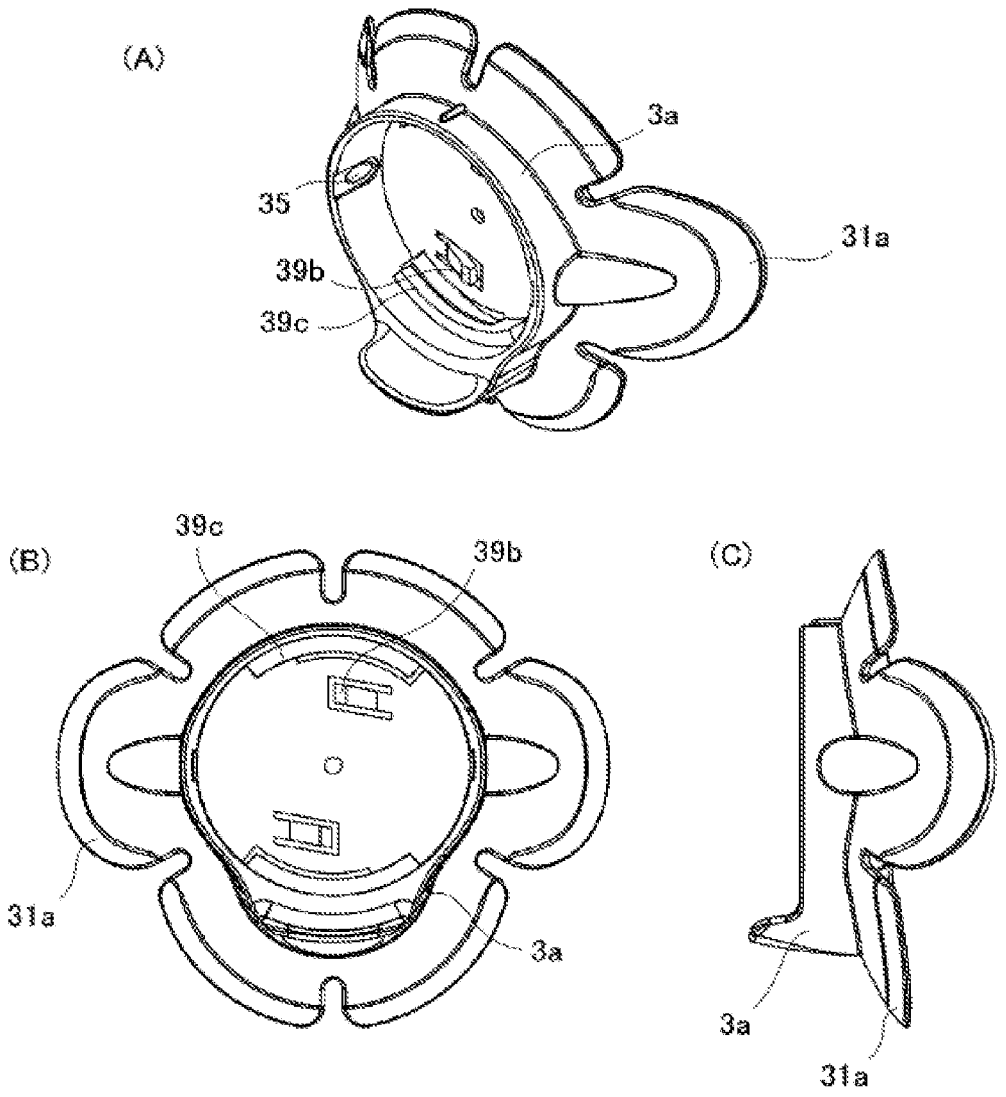
FIG. 16A is a perspective view showing a base of the shoelace winding device according to the second embodiment of the present invention.
FIG. 16B is a plan view showing the base of the shoelace winding device according to the second embodiment of the present invention.
FIG. 16C is a side view showing the base of the shoelace winding device according to the second embodiment of the present invention.
Figure 17:
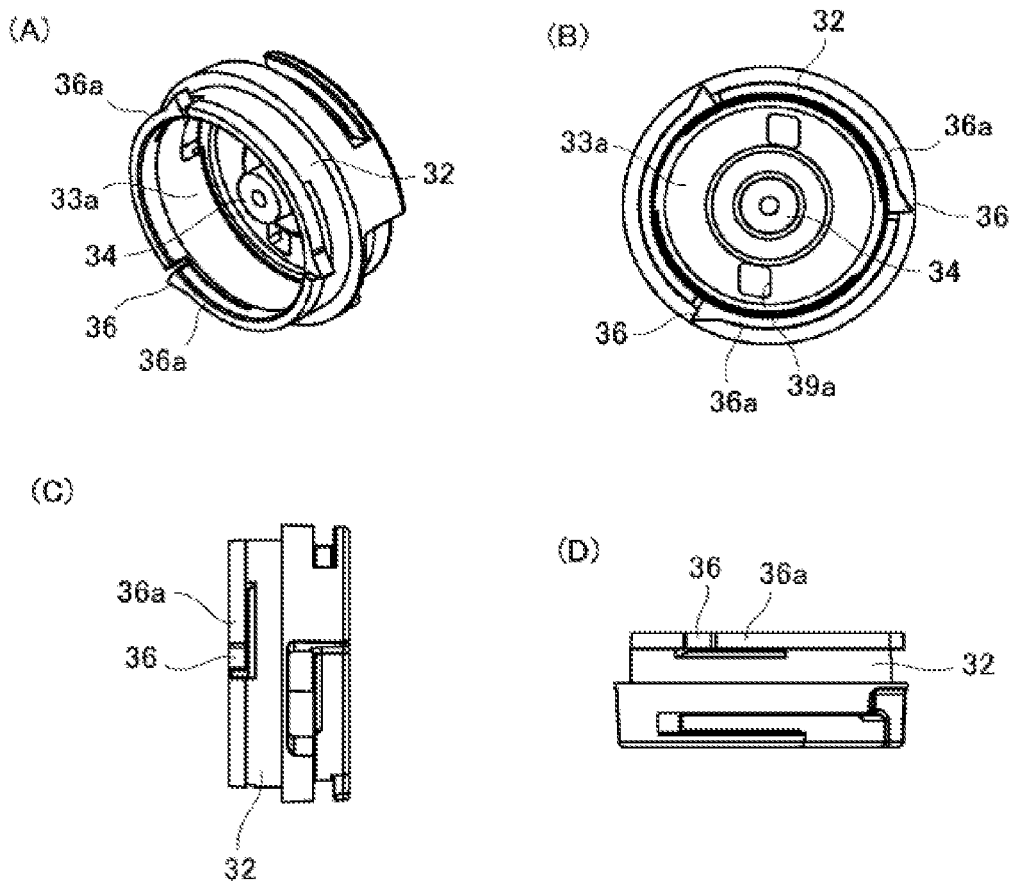
FIG. 17A is a perspective view showing a drum accommodation portion of the shoelace winding device according to the second embodiment of the present invention.
FIG. 17B is a plan view showing the drum accommodation portion of the shoelace winding device according to the second embodiment of the present invention.
FIG. 17C is a side view showing the drum accommodation portion of the shoelace winding device according to the second embodiment of the present invention.
FIG. 17D is a front view showing the drum accommodation portion of the shoelace winding device according to the second embodiment of the present invention.

For example, as another embodiment (second embodiment: FIGS. 11 to 17), a shoelace winding device 102 including a base 3*a* located at the heel part of the shoe S as shown in FIG. 13 may be embodied.

Each of the embodiments in this specification has the same structure as the first embodiment, which will not be described.

In the shoelace winding device 102 according to the second embodiment, the shape of the flange 31 of the base 3 of the shoelace winding device 1 according to the first embodiment is curved to conform to the shape of the heel part. Further, a flange 31*a* in which the shape of the flange 31 is entirely changed to be like a flower petal is employed.

Additionally, in the shoelace winding device 102, the annular wall 32, the rotation shaft 34, the pawls 36, and the spring portions 36*a* of the shoelace winding device 1 according to the first embodiment are configured as a drum accommodation portion 33*a*, which is separate from the base 3*a*.

The drum accommodation portion 33*a* includes engagement holes 39*a* located at the bottom of the drum accommodation portion 33*a*. The engagement holes 39*a* are designed to engage with engagement protrusions 39*b* extending from the base 3*a*.

To fix the drum accommodation portion 33*a* to the base 3*a*, guides 39*c* located on the base 3*a* are correspondingly fitted to the lower end of the drum accommodation portion 33*a* to rotate the drum accommodation portion 33*a*. This allows the drum accommodation portion 33*a* to be fixed to the base 3*a*.

In this fixed state, the engagement holes 39*a* are engaged with the engagement protrusions 39*b*. This prevents the drum accommodation portion 33*a* from rotating in the opposite direction and inhibits the removal of the drum accommodation portion 33*a* from the base 3*a*.

To remove the base 3*a* from the drum accommodation portion 33*a*, the engagement protrusions 39*b* are pressed downward from the upper side of the drum accommodation portion 33*a*. This cancels the engagement of the engagement holes 39*a* and allows the drum accommodation portion 33*a* to rotate in the opposite direction. Thus, the drum accommodation portion 33*a* can be removed from the base 3*a*.

Thus, in the shoelace winding device 102, when a fault occurs in the pawls 36, the spring portions 36*a*, the rotation shaft 34, or the like of the drum accommodation portion 33*a*, the fault can be easily overcome without breaking the shoe S just by removing the drum accommodation portion 33*a* from the base 3*a* and exchanging the drum accommodation portion 33*a*.

Figure 18:
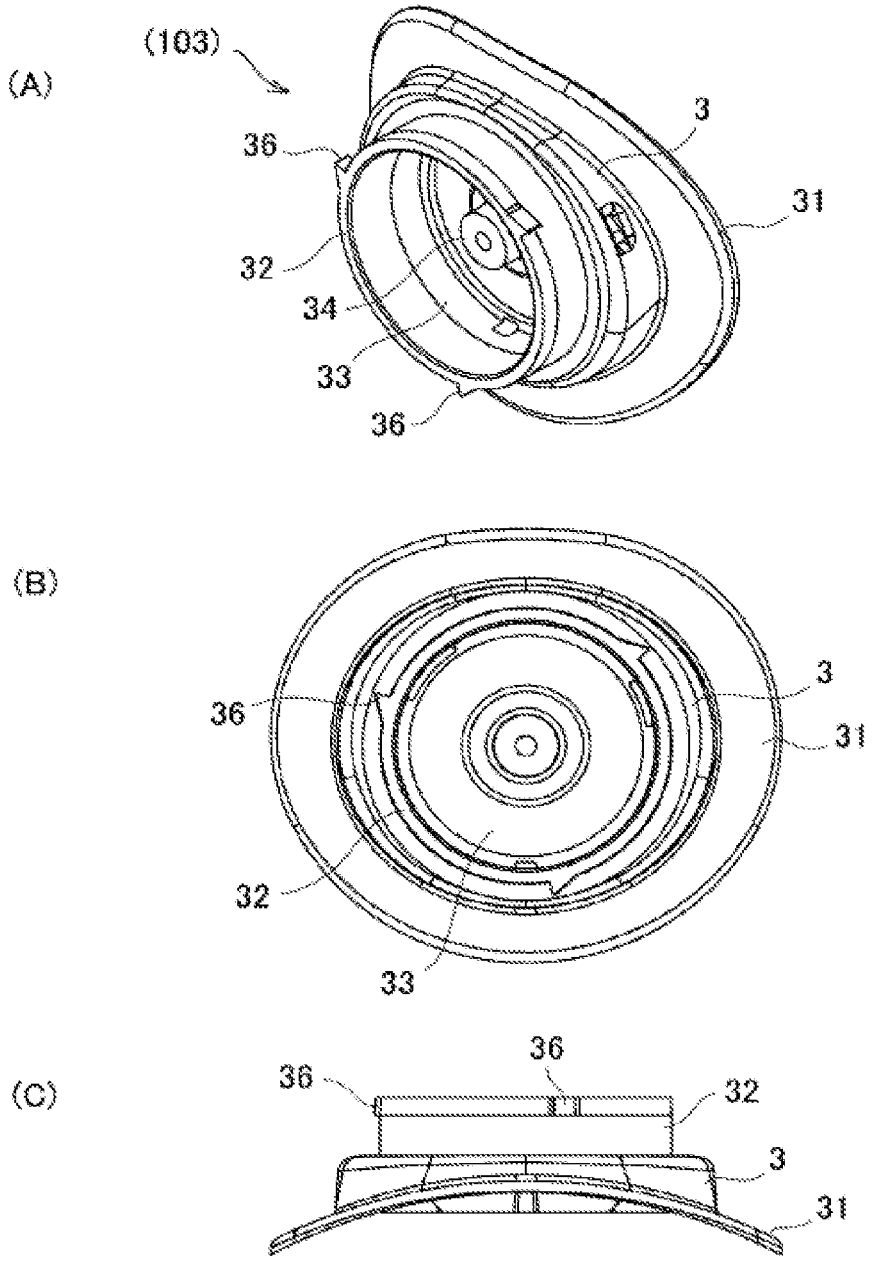
FIG. 18A is a perspective view showing a base of a shoelace winding device according to a third embodiment of the present invention.
FIG. 18B is a plan view showing the base of the shoelace winding device according to the third embodiment of the present invention.
FIG. 18C is a front view showing the base of the shoelace winding device according to the third embodiment of the present invention.

The winding device of the present invention may be, as a further embodiment (third embodiment: FIG. 18), embodied as a shoelace winding device 103. The shoelace winding device 103 does not include cutouts in the proximity of the pawls 36 of the annular wall 32, which configures the drum accommodation portion 33.

The third embodiment differs from the first embodiment in that the spring portions 36*a* are not included. Thus, at least one of the following numbered changes in structure needs to be employed so that the pawls 36 slide up and over the projections of the annular gear 53 and the dial 5 rotates only in a single direction.

1. Change the thickness or material of the annular wall 32 to increase the elasticity of the surrounding parts of the pawls 36.

2. Change the thickness or material of the dial 5 to increase the elasticity of the annular gear 53.

3. Use the pawls 36 or the projections of the annular gear 53 that are elastically deformable.

4. Increase the number of pawls 36 to lessen the force applied to each pawl 36.

Figure 19:
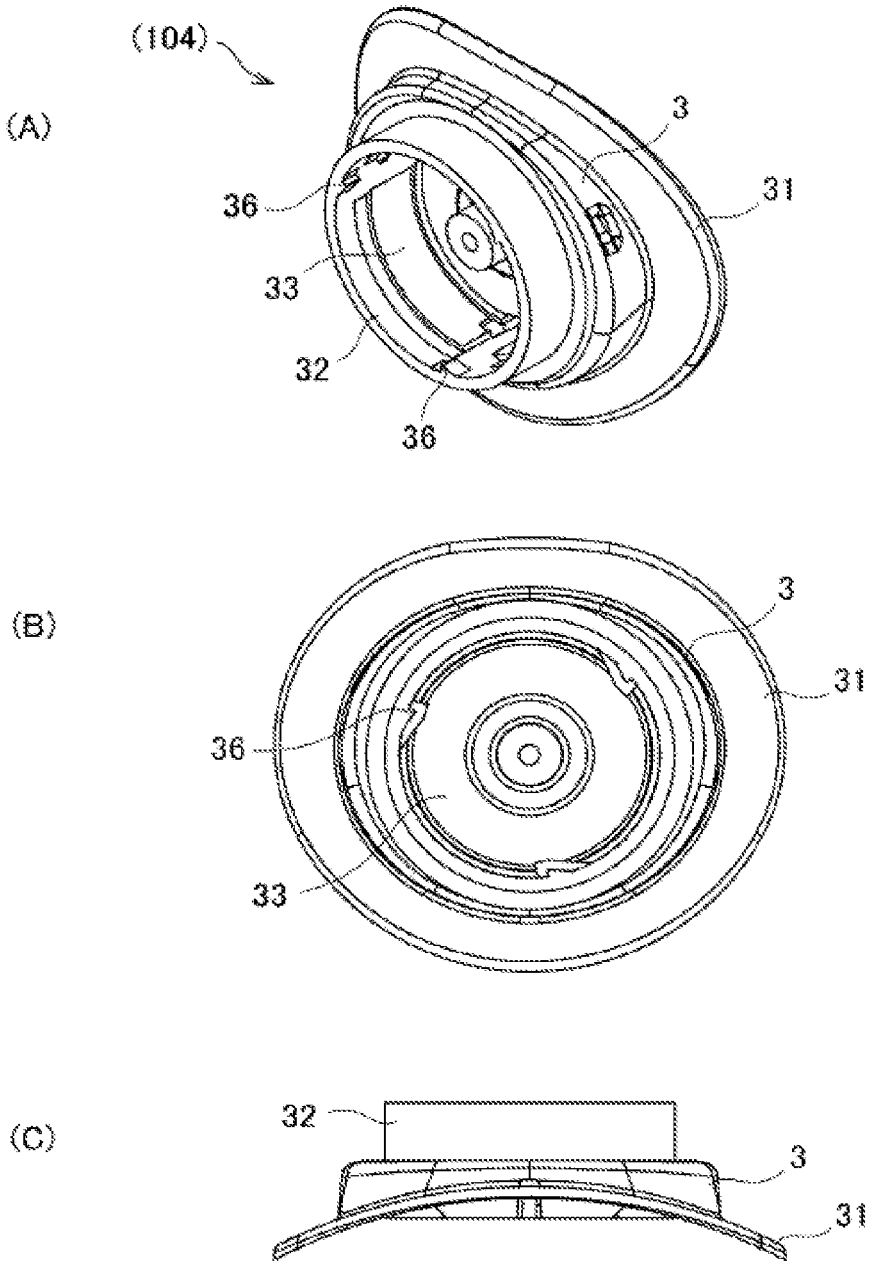
FIG. 19A is a perspective view showing a base of a shoelace winding device according to a fourth embodiment of the present invention.
FIG. 19B is a plan view showing the base of the shoelace winding device according to the fourth embodiment of the present invention.
FIG. 19C is a front view showing the base of the shoelace winding device according to the fourth embodiment of the present invention.
Figure 20:
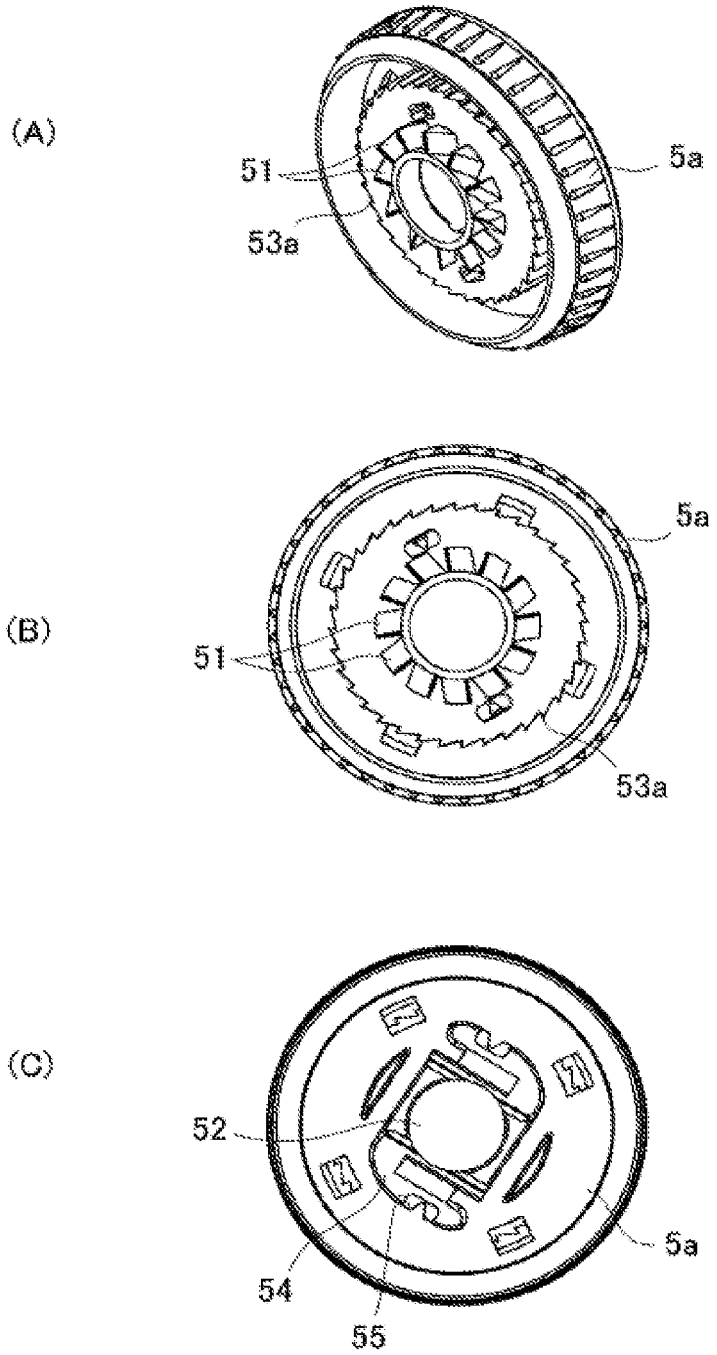
FIG. 20A is a perspective view showing a dial of the shoelace winding device according to the fourth embodiment of the present invention.
FIG. 20B is a bottom view showing the dial of the shoelace winding device according to the fourth embodiment of the present invention.
FIG. 20C is a plan view showing the dial of the shoelace winding device according to the fourth embodiment of the present invention.

The winding device of the present invention may be, as a further embodiment (fourth embodiment: FIGS. 19 and 20), embodied as a shoelace winding device 104. In the same manner as the third embodiment, the fourth embodiment does not include cutouts in the proximity of the pawls 36 of the annular wall 32, which configures the drum accommodation portion 33.

The shoelace winding device 104 differs from the shoelace winding device 103 of the third embodiment in that the pawls 36 protrude toward the inside of the annular wall 32.

Thus, the shoelace winding device 104 includes a dial 5*a* provided with a columnar annular gear 53*a* instead of the dial 5 provided with the cylindrical annular gear 53, which is used for each of the above-described embodiments.

More specifically, the dial 5*a* includes the annular gear 53*a* provided with projections and troughs extending in a rotation axis direction of the dial 5*a* on the outer side of the downward teeth 51. The annular gear 53*a* is designed to engage with the pawls 36, which extend inward, to limit the rotation direction of the dial 5*a* to a single direction.

Figure 21:
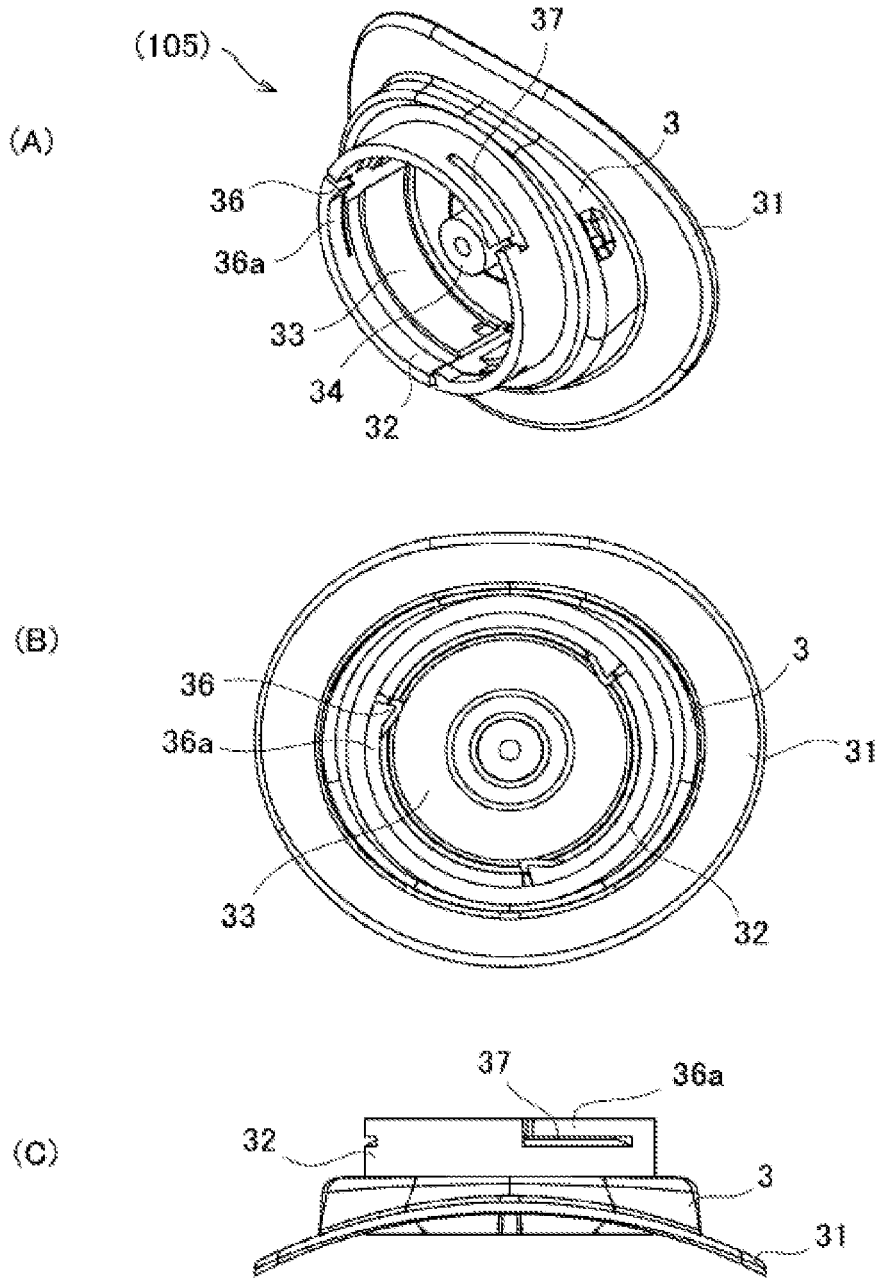
FIG. 21A is a perspective view showing a base of a shoelace winding device according to a fifth embodiment of the present invention.
FIG. 21B is a plan view showing the base of the shoelace winding device according to the fifth embodiment of the present invention.
FIG. 21C is a front view showing the base of the shoelace winding device according to the fifth embodiment of the present invention.

The winding device of the present invention may be, as a further embodiment (fifth embodiment: FIG. 21), embodied as a shoelace winding device 105. The shoelace winding device 105 includes cutouts 37 in the proximity of the pawls 36 of the annular wall 32, which configures the drum accommodation portion 33, in the shoelace winding device 104 of the fourth embodiment.

More specifically, in the shoelace winding device 105 of the fifth embodiment, the pawls 36, which protrude toward the inside of the drum accommodation portion 33, are located at the tips of the spring portions 36*a*. Engagement of the projections of the columnar annular gear 53*a* of the dial 5*a* with the pawls 36 limits the rotation direction of the dial 5*a* to a single direction.

Figure 22:
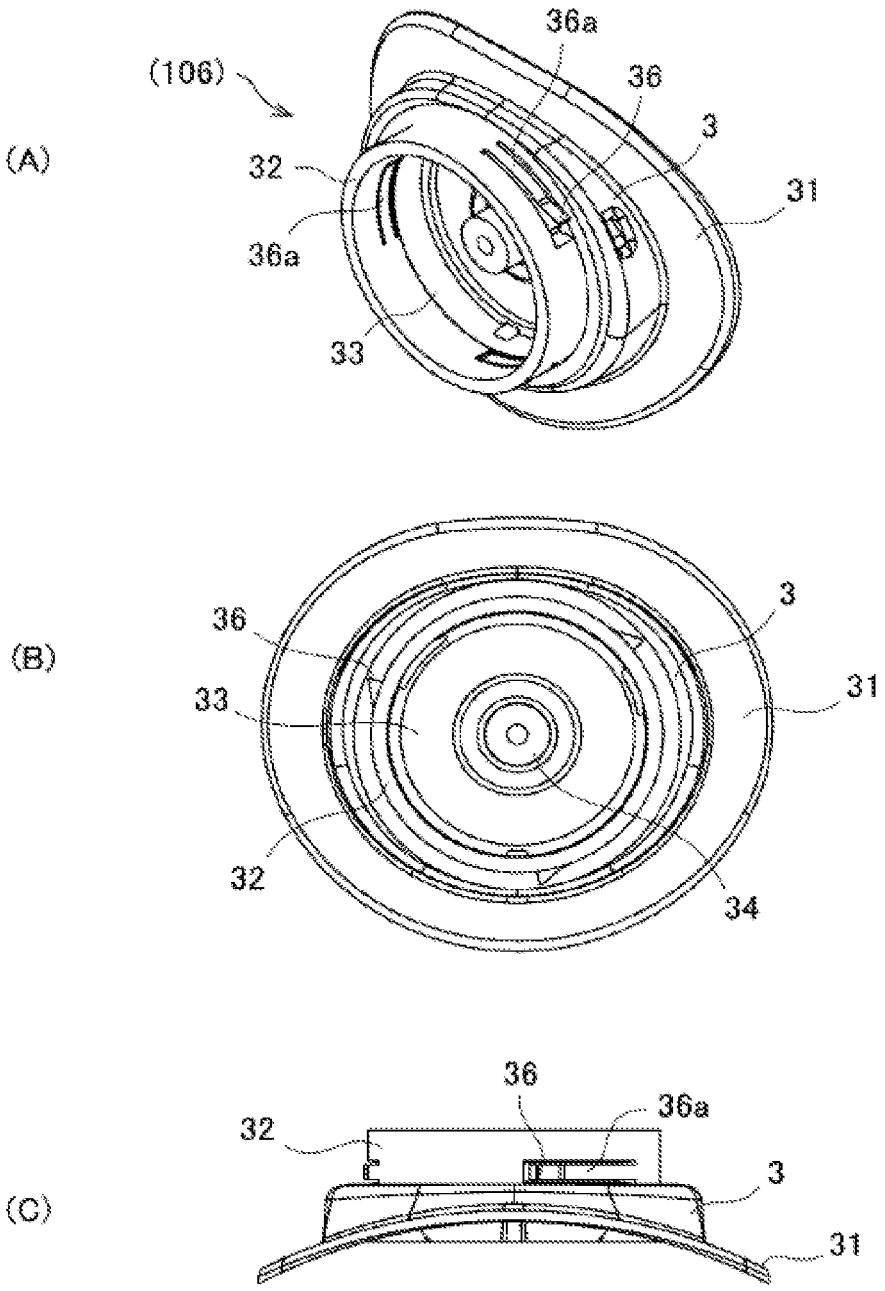
FIG. 22A is a perspective view showing a base of a shoelace winding device according to a sixth embodiment of the present invention.
FIG. 22B is a plan view showing the base of the shoelace winding device according to the sixth embodiment of the present invention.
FIG. 22C is a front view showing the base of the shoelace winding device according to the sixth embodiment of the present invention.

The winding device of the present invention may be, as a further embodiment (sixth embodiment: FIG. 22), embodied as a shoelace winding device 106. The shoelace winding device 106 differs from the shoelace winding device 1 of the first embodiment in that the pawls 36 and the spring portions 36*a* are formed in the lower part of the drum accommodation portion 33.

In this embodiment, the annular wall 32 is located around the spring portions 36*a*. This protects the spring portions 36*a* and increases the operability of the base 3.

In addition, the thickness of the winding device is decreased to reduce the device in size.

In this embodiment, the pawls 36 protrude toward the outside of the drum accommodation portion 33. Instead, in the shoelace winding device, the pawls 36 may protrude toward the inside of the drum accommodation portion 33 (in the center direction).

Figure 23:
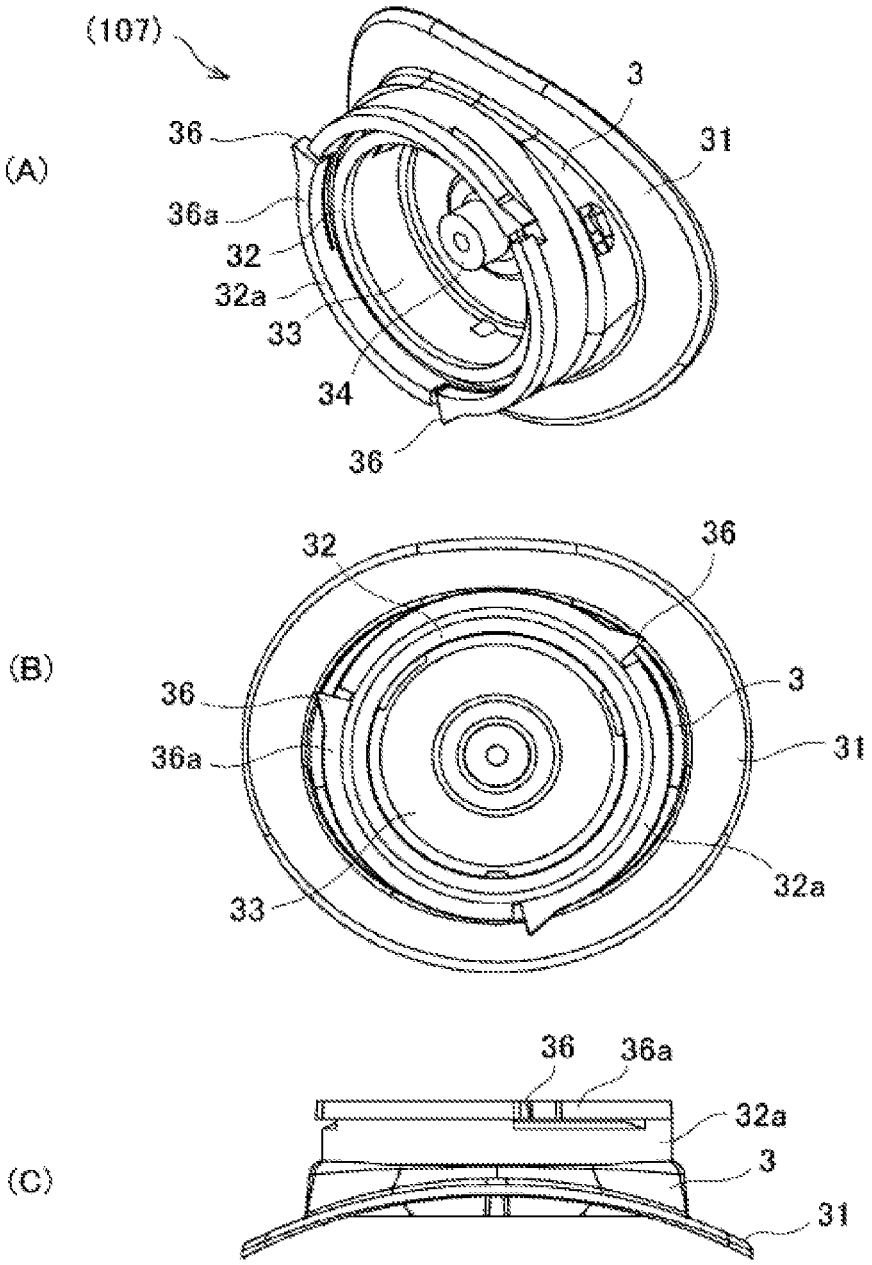
FIG. 23A is a perspective view showing a base of a shoelace winding device according to a seventh embodiment of the present invention.
FIG. 23B is a plan view showing the base of the shoelace winding device according to the seventh embodiment of the present invention.
FIG. 23C is a front view showing the base of the shoelace winding device according to the seventh embodiment of the present invention.

The winding device of the present invention may be, as a further embodiment (seventh embodiment: FIG. 23), embodied as a shoelace winding device 107. In the shoelace winding device 107, the pawls 36 protrude outward from a cylindrical annular portion 32*a* that protrudes from the base 3 on the outside of the annular wall 32 of the drum accommodation portion 33.

More specifically, in the shoelace winding device 107, the spring portions 36*a* and the pawls 36 are not formed on the annular wall 32. Instead, the pawls 36 are formed on the tips of the spring portions 36*a* formed by cutting out the annular portion 32*a* located on the same center circle as the annular wall 32.

The pawls 36 on the annular portion 32*a* protrude outward. Engagement of the pawls 36 with the projections of the annular gear 53 of the dial 5 limits the rotation direction of the dial 5 to a single direction. Thus, the outer diameter of the dial 5 needs to be larger than that of other embodiments.

In this embodiment, the pawls 36 protrude outward. Instead, in the shoelace winding device, the pawls 36 may protrude toward the drum accommodation portion 33 (in the center direction).

Figure 24:
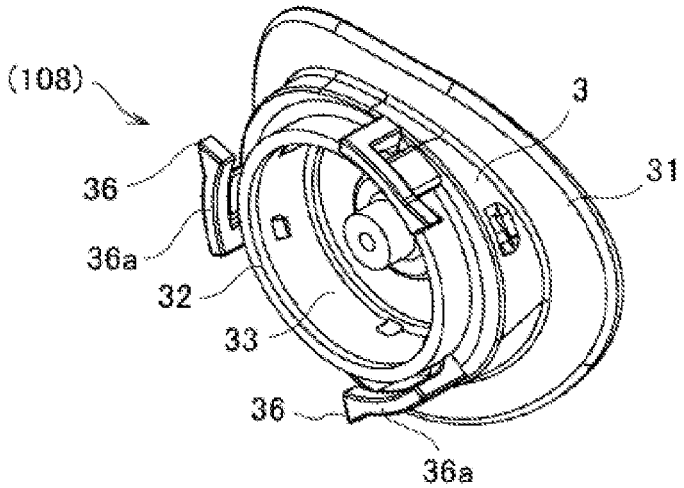
FIG. 24A is a perspective view showing a base of a shoelace winding device according to an eighth embodiment of the present invention.
FIG. 24B is a plan view showing the base of the shoelace winding device according to the eighth embodiment of the present invention.
FIG. 24C is a front view showing the base of the shoelace winding device according to the eighth embodiment of the present invention.
Figure 24:
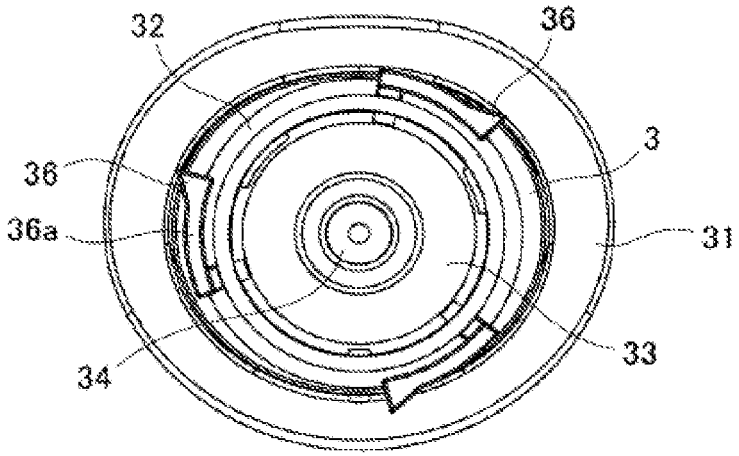
Figure 24:
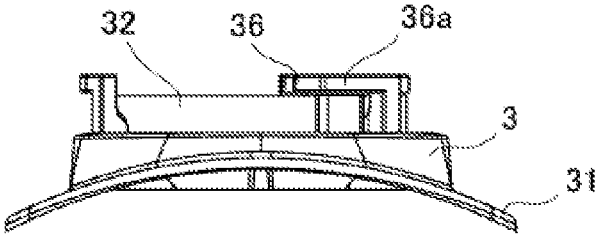

The winding device of the present invention may be, as a further embodiment (eighth embodiment: FIG. 24), embodied as a shoelace winding device 108. In the shoelace winding device 108, the pawls 36 mounted on the spring portions 36*a* to protrude from the annular wall 32 are located on the outside of the annular wall 32 of the drum accommodation portion 33.

More specifically, in the shoelace winding device 108, the spring portions 36*a* and the pawls 36, which are separate members, are attached to the annular wall 32, and the pawls 36 are formed on the tips of three spring portions 36*a* located on the same center circle as the annular wall 32.

The pawls 36 on the spring portions 36*a* protrude outward. Engagement of the pawls 36 with the projections of the annular gear 53 of the dial 5 limits the rotation direction of the dial 5 to a single direction.

In this embodiment, the pawls 36 protrude toward the outside of the drum accommodation portion 33. Instead, in the shoelace winding device, the pawls 36 may protrude toward the drum accommodation portion 33 (in the center direction).

Figure 25:
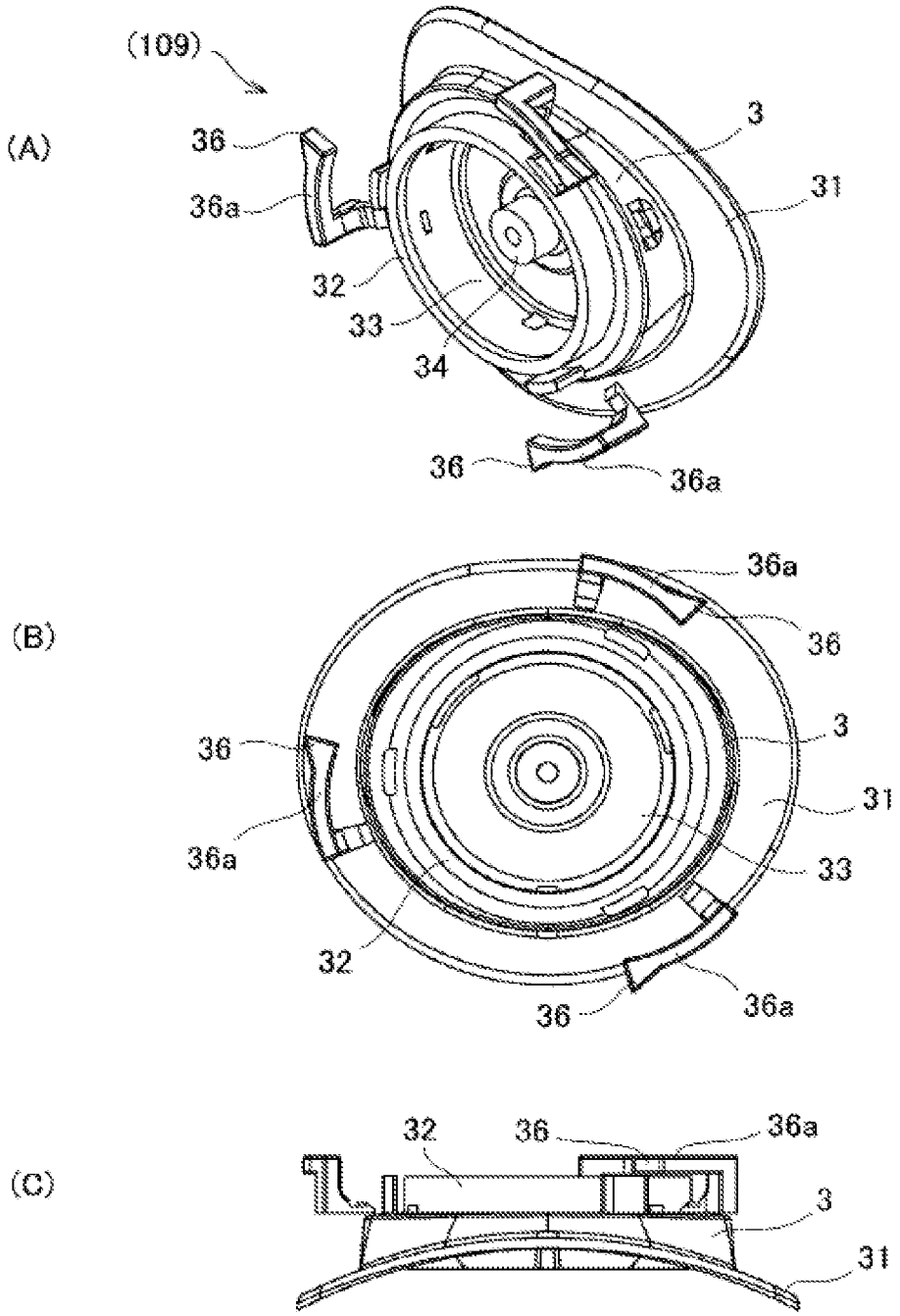
FIG. 25A is a perspective view showing a base of a shoelace winding device according to a ninth embodiment of the present invention.
FIG. 25B is a plan view showing the base of the shoelace winding device according to the ninth embodiment of the present invention.
FIG. 25C is a front view showing the base of the shoelace winding device according to the ninth embodiment of the present invention.

The winding device of the present invention may be, as a further embodiment (ninth embodiment: FIG. 25), embodied as a shoelace winding device 109. The shoelace winding device 109 includes the pawls 36 respectively formed on the spring portions 36*a* protruding from the base 3 on the outside of the annular wall 32 of the drum accommodation portion 33.

More specifically, in the shoelace winding device 109, the spring portions 36*a* and the pawls 36 are not formed on the annular wall 32. Instead, the pawls 36 are formed on the tips of three spring portions 36*a* protruding from the same center circle as the annular wall 32.

The pawls 36 on the spring portions 36*a* protrude outward. Engagement of the pawls 36 with the projections of the annular gear 53 of the dial 5 limits the rotation direction of the dial 5 to a single direction.

In this embodiment, the pawls 36 protrude toward the outside of the drum accommodation portion 33. Instead, in the shoelace winding device, the pawls 36 may protrude toward the drum accommodation portion 33 (in the center direction).

Figure 26:
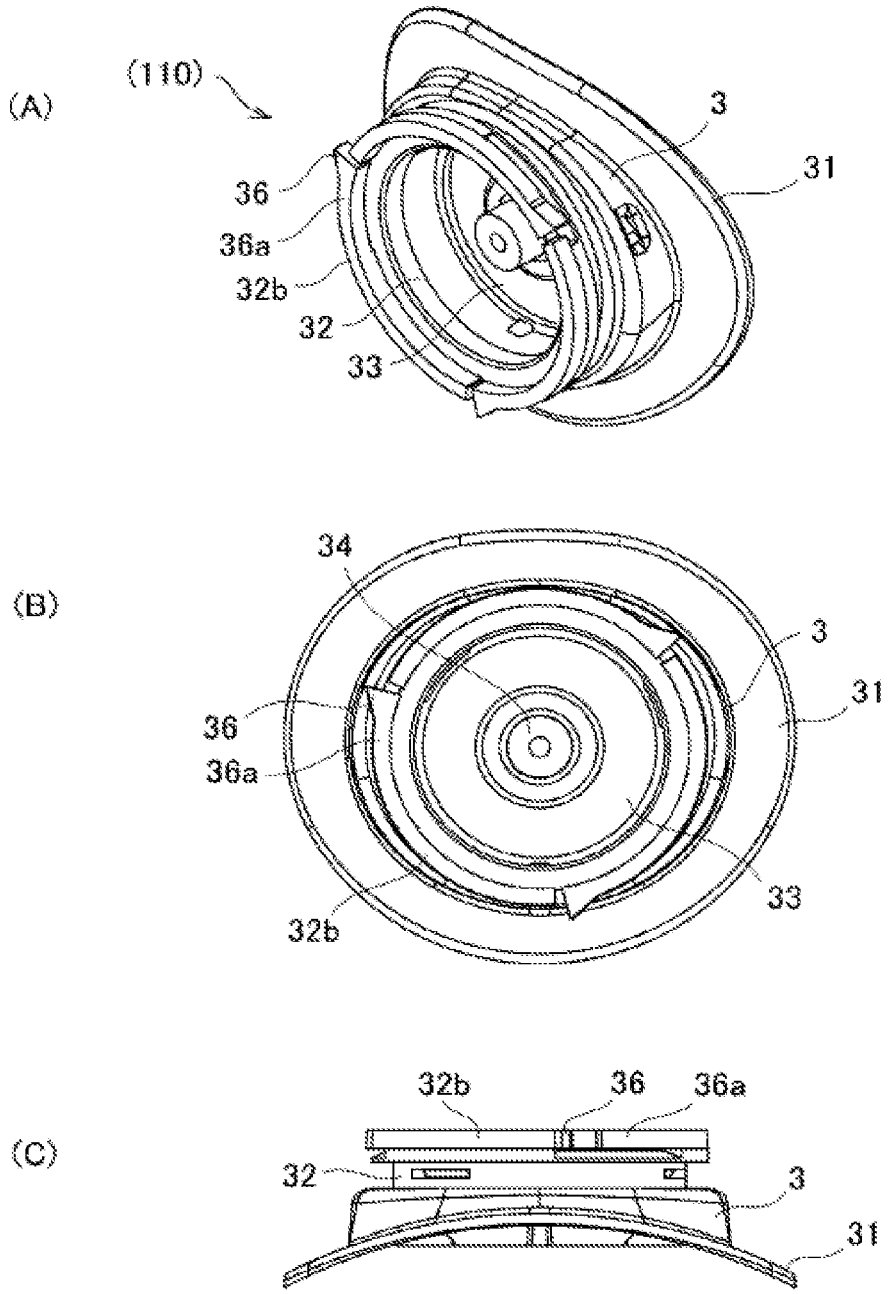
FIG. 26A is a perspective view showing a base of a shoelace winding device according to a tenth embodiment of the present invention.
FIG. 26B is a plan view showing the base of the shoelace winding device according to the tenth embodiment of the present invention.
FIG. 26C is a front view showing the base of the shoelace winding device according to the tenth embodiment of the present invention.
Figure 27:
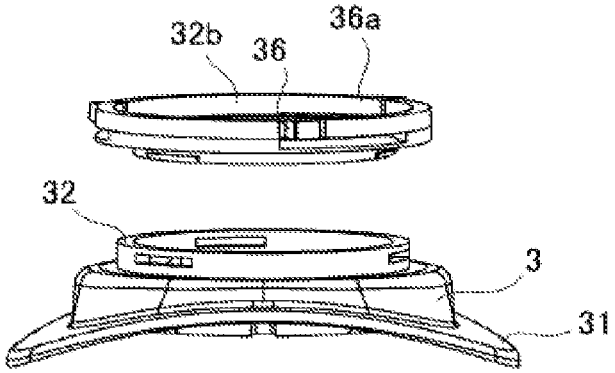
FIG. 27 is a front perspective view showing the base and an annular portion according to the tenth embodiment of the present invention.

The winding device of the present invention may be, as a further embodiment (tenth embodiment: FIGS. 26 and 27), embodied as a shoelace winding device 110. In the shoelace winding device 110, a ring-shaped annular portion 32*b*, which is separate from the annular wall 32, is fixed on the annular wall 32 of the drum accommodation portion 33, and the pawls 36 are located on the tips of the spring portions 36*a* formed by partially cutting out the annular portion 32*b*.

More specifically, in the shoelace winding device 110, the spring portions 36*a* and the pawls 36, which are separate members, are attached to the annular wall 32, and the pawls 36 are formed on the tips of three spring portions 36*a* on the same center circle as the annular wall 32.

The pawls 36 on the spring portions 36*a* protrude outward. Engagement of the pawls 36 with the projections of the annular gear 53 of the dial 5 limits the rotation direction of the dial 5 to a single direction.

Figure 28:
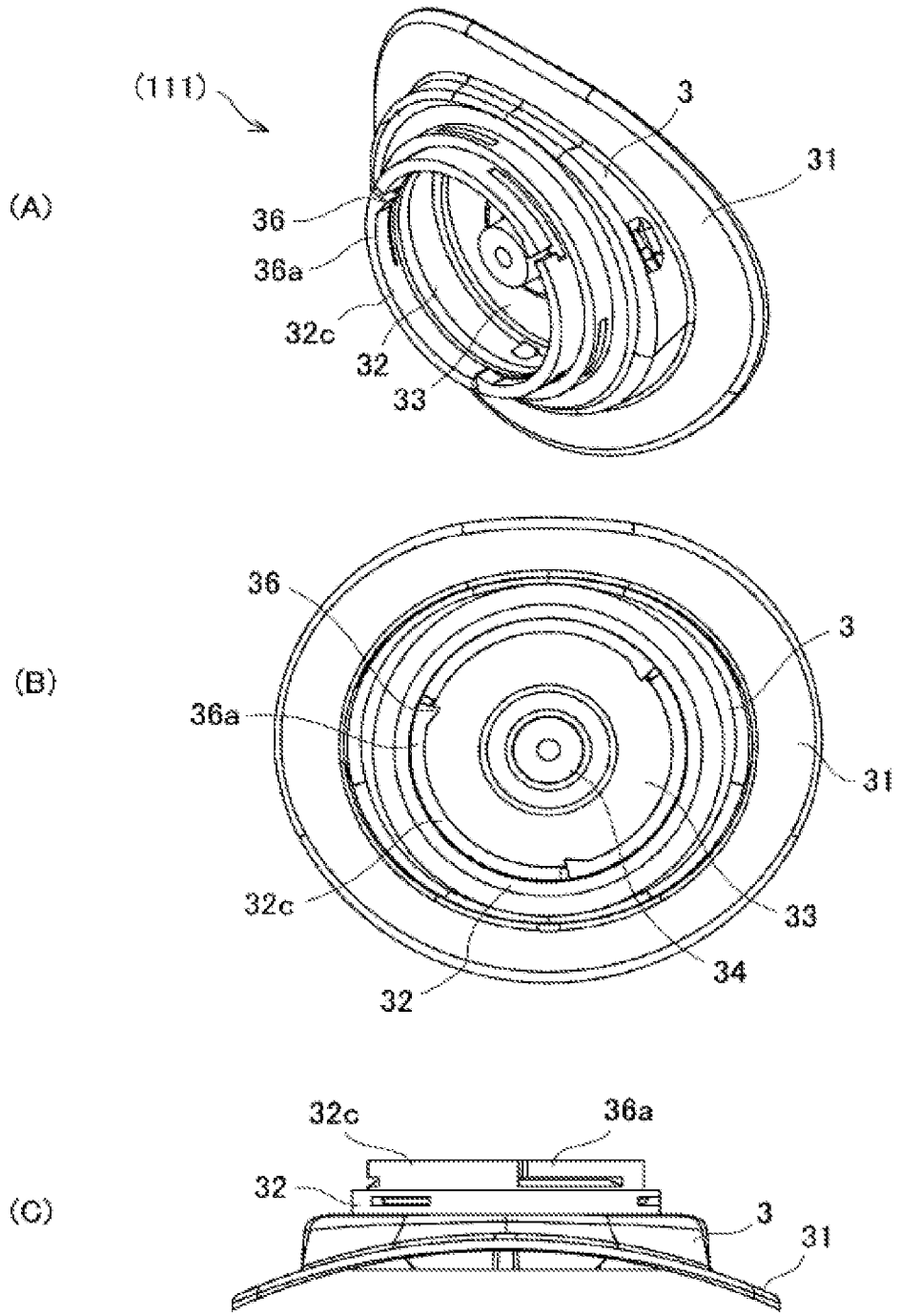
FIG. 28A is a perspective view showing a base of a shoelace winding device according to an eleventh embodiment of the present invention.
FIG. 28B is a plan view showing the base of the shoelace winding device according to the eleventh embodiment of the present invention.
FIG. 28C is a front view showing the base of the shoelace winding device according to the eleventh embodiment of the present invention.
Figure 29:
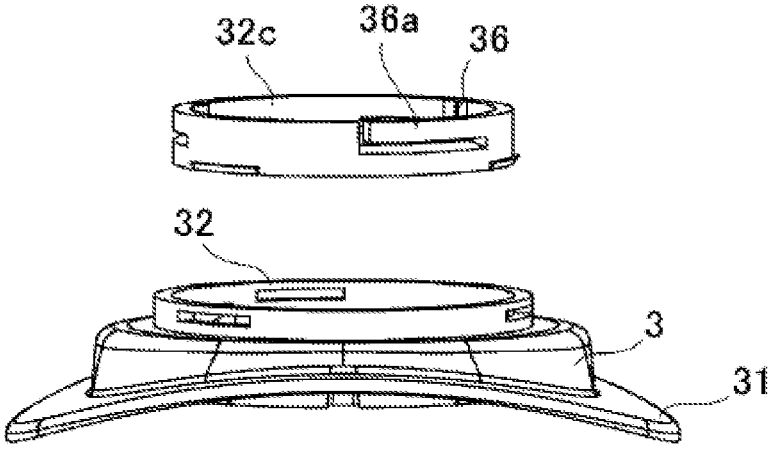
FIG. 29 is a front perspective view showing the base and an annular portion according to the eleventh embodiment of the present invention.

The winding device of the present invention may be, as a further embodiment (eleventh embodiment: FIGS. 28 and 29), embodied as a shoelace winding device 111. In the shoelace winding device 111, a ring-shaped annular portion 32*c*, which is separate from the annular wall 32, is fixed on the annular wall 32 of the drum accommodation portion 33, and the pawls 36 are located on the tip of the spring portions 36*a* formed by partially cutting out the annular portion 32*c*.

More specifically, in the shoelace winding device 111, the spring portions 36*a* and the pawls 36, which are separate members, are attached to the annular wall 32, and the pawls 36 are formed on the tips of three spring portions 36*a* on the same center circle as the annular wall 32.

The pawls 36 on the spring portions 36*a* protrude inward. Engagement of the pawls 36 with the projections of the columnar annular gear 53*a* of the dial 5*a* limits the rotation direction of the dial 5*a* to a single direction.

When the annular portion 32*b* or the annular portion 32*c* formed as a separate member on the annular wall 32 is used for the shoelace winding device 110 of the tenth embodiment and the shoelace winding device 111 of the eleventh embodiment, a fault that occurs in the spring portions 36*a* can be overcome by exchanging the annular portion 32*b* or the annular portion 32*c*.

Additionally, the present invention may be embodied as a winding device that winds a lace other than a shoelace. The materials, shapes, positions, sizes, number, and the like of the components of the winding device may be changed without departing from the spirit or scope of the invention.

INDUSTRIAL APPLICABILITY

The present invention is industrially available in a preferred manner as a small-sized, lightweight winding device that is excellent in durability, operability, and maintenance.

DESCRIPTION OF REFERENCE CHARACTERS

1) shoelace winding device; 2) shoelace; 3) base; 3*a*) base (second embodiment); 31) flange; 31*a*) flange; 32) annular wall; 32*a*) annular portion (seventh embodiment); 32*b*) annular portion (tenth embodiment); 32*c*) annular portion (eleventh embodiment); 33) drum accommodation portion; 33*a*) drum accommodation portion (second embodiment); 34) rotation shaft; 35) shoelace drawing port; 36) pawl 36*a*) spring portion; 37) cutout; 39*a*) engagement hole; 39*b*) engagement protrusion; 39*c*) guide; 4) drum; 41) shoelace winding portion; 42) rotation shaft portion; 43) recess; 44) locking protuberance; 45) insertion hole; 46) upward teeth; 5) dial; 5*a*) dial (fourth, fifth, and eleventh embodiments); 51) downward teeth; 52) shaft hole; 53) annular gear; 53*a*) annular gear (fourth, fifth, and eleventh embodiments); 54) spring accommodation portion; 55) locking portion; 6) shaft member; 61) bearing; 62) flange; 63) screw insertion hole; 7) spring member; 71) shaft part (first end); 72) second end; 8) screw; 9) cover; 9*a*) through-hole; 102) shoelace winding device (second embodiment); 103) shoelace winding device (third embodiment); 104) shoelace winding device (fourth embodiment); 105) shoelace winding device (fifth embodiment); 106) shoelace winding device (sixth embodiment); 107) shoelace winding device (seventh embodiment); 108) shoelace winding device (eighth embodiment); 109) shoelace winding device (ninth embodiment); 110) shoelace winding device (tenth embodiment); 111) shoelace winding device (eleventh embodiment); S) shoe

The invention claimed is:

1. A winding device comprising:

a drum including upward teeth located on an upper side of the drum, wherein the drum is configured to wind a lace;

a base including a drum accommodation portion that accommodates the drum, wherein the accommodation portion is cylindrical and has a closed end;

a dial including downward teeth located on a lower side of the dial and engaging with the upward teeth of the drum to rotate the drum, wherein the dial is moved along a rotation axis direction of the dial to a locked state in which the downward teeth of the dial are engaged with the upward teeth of the drum to transmit rotation of the dial to the drum and an unlocked state in which the downward teeth are disengaged from the upward teeth of the drum to freely rotate the drum;

an annular gear formed on a circumferential portion of the dial, wherein the annular gear includes projections and troughs extending in the rotation axis direction of the dial; and a pawl protruding from the drum accommodation portion, wherein the pawl engages with the annular gear, wherein the pawl protrudes outward from a spring portion arranged concyclically with a cylindrical annular wall that configures the drum accommodation portion, wherein the pawl is integrated with the cylindrical annular wall that configures the drum accommodation portion, and wherein:

the pawl protrudes outward from the spring portion formed by cutting out the cylindrical annular wall that configures the drum accommodation portion, and elastic deformation of the spring portion toward an inside of the drum accommodation portion causes the pawl to slide up and over the projection of the annular gear, which is formed to be cylindrical on the circumferential portion of the dial, allowing the dial to rotate, and wherein the annular gear and the pawl control rotation of the dial.

2. The winding device according to claim 1, wherein a cutout formed on the annular wall, which is cylindrical, spreads outward, and a gap between an inside of the cutout and the spring portion is extremely small.

3. The winding device according to claim 1, wherein the dial integrally includes the downward teeth and the annular gear, and the dial accommodates a spring that switches the dial between a locked position at which rotation of the dial is transmitted to the drum and a cancelled position at which the drum freely rotates, and a shaft member that holds the spring.

* * * * *